US009251800B2

(12) United States Patent
Norvell et al.

(10) Patent No.: US 9,251,800 B2
(45) Date of Patent: Feb. 2, 2016

(54) GENERATION OF A HIGH BAND EXTENSION OF A BANDWIDTH EXTENDED AUDIO SIGNAL

(75) Inventors: Erik Norvell, Stockholm (SE); Volodya Grancharov, Solna (SE); Tomas Jansson Toftgård, Uppsala (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 0 days.

(21) Appl. No.: 14/355,811

(22) PCT Filed: Sep. 4, 2012

(86) PCT No.: PCT/SE2012/050937

§ 371 (c)(1),
(2), (4) Date: May 1, 2014

(87) PCT Pub. No.: WO2013/066238

PCT Pub. Date: May 10, 2013

(65) Prior Publication Data

US 2014/0257827 A1 Sep. 11, 2014

Related U.S. Application Data

(60) Provisional application No. 61/554,573, filed on Nov. 2, 2011, provisional application No. 61/589,618, filed on Jan. 23, 2012.

(51) Int. Cl.

| | |
|---|---|
| ***G10L 19/26*** | (2013.01) |
| ***G10L 21/038*** | (2013.01) |
| *G10L 19/12* | (2013.01) |

(52) U.S. Cl.

CPC ..... *G10L 19/26* (2013.01); *G10L 21/038* (2013.01); *G10L 19/12* (2013.01)

(58) Field of Classification Search

None

See application file for complete search history.

(56) References Cited

U.S. PATENT DOCUMENTS

| | | | | |
|---|---|---|---|---|
| 5,953,697 | A | 9/1999 | Lin et al. | |
| 7,801,733 | B2 * | 9/2010 | Lee et al. | 704/500 |
| 8,856,011 | B2 * | 10/2014 | Sverrisson et al. | 704/500 |
| 2003/0093271 | A1 * | 5/2003 | Tsushima et al. | 704/230 |
| 2003/0187663 | A1 | 10/2003 | Truman et al. | |
| 2006/0149532 | A1 | 7/2006 | Boillot et al. | |
| 2010/0198587 | A1 | 8/2010 | Ramabadran et al. | |
| 2011/0150240 | A1 * | 6/2011 | Akiyama et al. | 381/98 |
| 2011/0178807 | A1 * | 7/2011 | Yang et al. | 704/500 |
| 2011/0216918 | A1 | 9/2011 | Nagel et al. | |

FOREIGN PATENT DOCUMENTS

| | | | |
|---|---|---|---|
| EP | 1308932 | A2 | 5/2003 |
| WO | WO 03044777 | A1 | 5/2003 |

OTHER PUBLICATIONS

International Search Report corresponding to International Application No. PCT/SE2012/050937 mailed May 29, 2013, 6 pages.

(Continued)

*Primary Examiner* — Jeremiah Bryar

(74) *Attorney, Agent, or Firm* — Myers Bigel Sibley & Sajovec, P.A.

(57) ABSTRACT

An audio decoder configured to generate a high band extension of an audio signal from an envelope and an excitation. The audio decoder includes a control arrangement configured to jointly control envelope shape and excitation noisiness with a common control parameter (f).

21 Claims, 16 Drawing Sheets

(56) References Cited

OTHER PUBLICATIONS

Written Opinion of the International Searching Authority corresponding to International Application No. PCT/SE2012/050937 mailed May 29, 2013, 5 pages.
International Report on Patentability corresponding to International Application No. PCT/SE2012/050937 mailed May 29, 2013, 14 pages.
Jie Zhan et al.: "Bandwidth Extension for China AVS-M standard", Acoustics, Speech and Signal Processing, 2009. IEEE International Conference on, Apr. 19, 2009, IEEE Piscataway, NJ, USA, ISBN 978-1-4244-2353-8; p. 4149-4152.
Fuchs G et al.: "A New Post-Filtering for Artificially Replicated High-Band in Speech Coders", Acoustics, Speech and Signal Processing, 2006. ICASSP 2006 Proceedings. 2006 IEEE International Conference on Toulouse, France May 14-19, 2006, Piscataway, NJ, USA, IEEE, ISBN 978-1-4244-0469-8; p. I-713-I-716.
Communication with Supplementary European Search Report, EP Application No. 12845743.9, Jul. 2, 2015.
Gustafsson et al., "Speech Bandwidth Extension", 2001 IEEE International Conference on Multimedia and Expo, Aug. 22, 2001, pp. 1016-1019.

* cited by examiner

GENERATION OF A HIGH BAND EXTENSION OF A BANDWIDTH EXTENDED AUDIO SIGNAL

CROSS REFERENCE TO RELATED APPLICATION

This application is a 35 U.S.C. §371 national stage application of PCT International Application No, PCT/SE2012/050937, filed on 4 Sep. 2012, which itself claims priority to U.S. Provisional Patent Application No. 61/554,573, filed 2 Nov. 2011, and U.S. Provisional Patent Application No. 61/589,618, filed 23 Jan. 2012, the disclosures of which are incorporated by reference herein in their entireties. The above-referenced PCT International Application was published in the English language as International Publication No. WO 2013/066238 A2 on 10 May 2013.

TECHNICAL FIELD

The proposed technology relates to generation of a high band extension of a bandwidth extended audio signal.

BACKGROUND

Most existing telecommunication systems operate on a limited audio bandwidth. Stemming from the limitations of the land-line telephony systems, most voice services are limited to only transmitting the lower end of the spectrum. Although the audio bandwidth is enough for most conversations, there is a desire to increase bandwidth to improve intelligibility and sense of presence. Although the capacity in telecommunication networks is continuously increasing, it is still of great interest to limit the required bandwidth per communication channel. In mobile networks smaller transmission bandwidths for each call yields lower power consumption in both the mobile device and the base station. This translates to energy and cost savings for the mobile operator, while the end user will experience prolonged battery life and increased talk-time. Further, with less consumed bandwidth per user the mobile network can service a larger number of users in parallel.

A property of the human auditory system is that the perception is frequency dependent. In particular, our hearing is less accurate for higher frequencies. This has inspired so called bandwidth extension (BWE) techniques, where a high frequency band is reconstructed from a low frequency band using limited resources.

The conventional BWE uses a representation of the spectral envelope of the extended high band signal, and reproduces the spectral fine structure of the signal by using a modified version of the low band signal. If the high band envelope is represented by a filter, the fine structure signal is often called the excitation signal. An accurate representation of the high band envelope is perceptually more important than the fine structure. Consequently, it is common that the available resources in terms of bits are spent on the envelope representation while the fine structure is reconstructed from the coded low band signal without additional side information. The basic concept of BWE is illustrated in FIG. 1.

The technology of BWE has been applied in a variety of audio coding systems. For example, the 3GPP AMR-WB+, [1], uses a time domain BWE based on a low band coder which switches between Code Excited Linear Predictor (CELP) speech coding and Transform Coded Residual (TCX) coding. Another example is the 3GPP eAAC transform based audio codec which performs a transform domain variant of BWE called Spectral Band Replication (SBR), [2]. Here, the excitation is created using a mixture of tonal components generated from the low-band excitation and a noise source in order to match the tonal to noise ratio of the input signal. In general, the noisiness of the signal can be described as a measure of how flat the spectrum is, e.g. using a spectral flatness measure. The noisiness can also be described as non-tonality, randomness or non-structure of the excitation. Increasing the noisiness of a signal is to make it more noise-like by e.g. mixing the signal with a noise signal from e.g. a random number generator or any other noise source. It can also be done by modifying the spectrum of the signal to make it more flat.

The spectral fine structure from the low band may be very different from the fine structure found in the high band. In particular, the combination of an excitation generated from the low band signal together with the high band envelope may produce undesired artifacts as residing harmonicity or shape of the excitation may be emphasized by the envelope shaping in an uncontrolled way. As a safety measure, it is common to flatten the high band envelope in order to limit undesired interaction between the excitation and the envelope. Although this solution may give a reasonable trade-off, the flatter envelope may be perceived as more noisy and the high band envelope will be less accurate.

SUMMARY

An object of the proposed technology is an improved control of the generation of the high band extension of a bandwidth extended audio signal.

This object is achieved in accordance with the attached claims.

A first aspect of the proposed technology involves a method of generating a high band extension of an audio signal from an envelope and an excitation. The method includes the step of jointly controlling envelope shape and excitation noisiness with a common control parameter.

A second aspect of the proposed technology involves an audio decoder configured to generate a high band extension of an audio signal from an envelope and an excitation. The audio decoder includes a control arrangement configured to jointly control envelope shape and excitation noisiness with a common control parameter.

A third aspect of the proposed technology involves a user equipment (UE) including an audio decoder in accordance with the second aspect.

A fourth aspect of the proposed technology involves an audio encoder including a spectral flatness estimator configured to determine, for transmission to a decoder, a measure of spectral flatness of a high band signal.

The proposed technology allows a more pronounced envelope structure which masks perceptual artifacts created by artificially generated high band excitations. At the same time joint control of envelope structure and noisiness of the excitation improves naturalness of the reconstructed audio signal.

BRIEF DESCRIPTION OF THE DRAWINGS

The proposed technology, together with further objects and advantages thereof, may best be understood by making reference to the following description taken together with the accompanying drawings.

DETAILED DESCRIPTION

In the following detailed description blocks performing the same or similar functions have been provided with the same reference designations.

Figure 1:
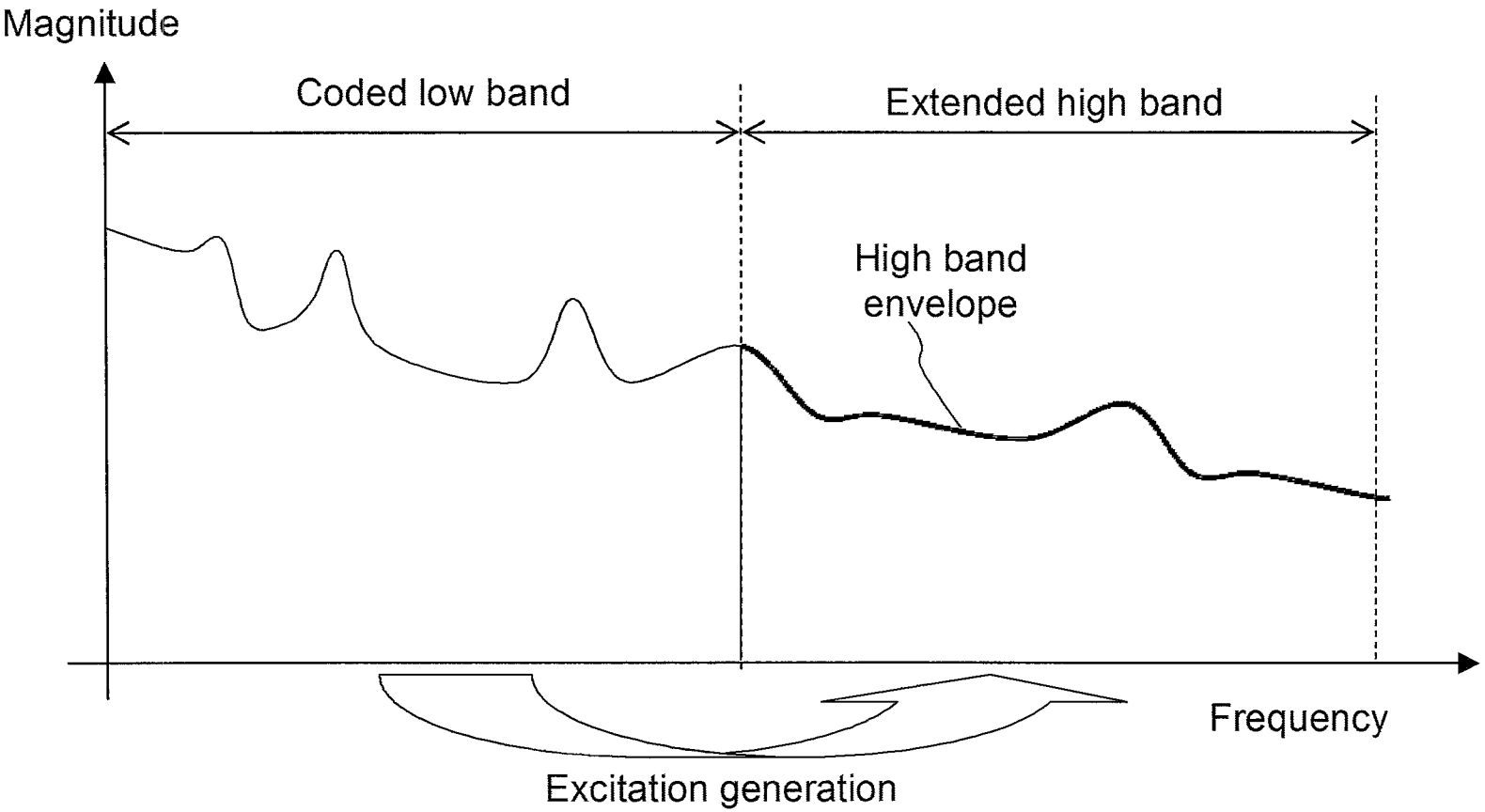
FIG. 1 illustrates the basic concept of the BWE technique in the form of a frequency spectrum. The coded low band signal is extended with a high band using a high band envelope and an excitation signal which is generated from the low band signal.
Figure 2:
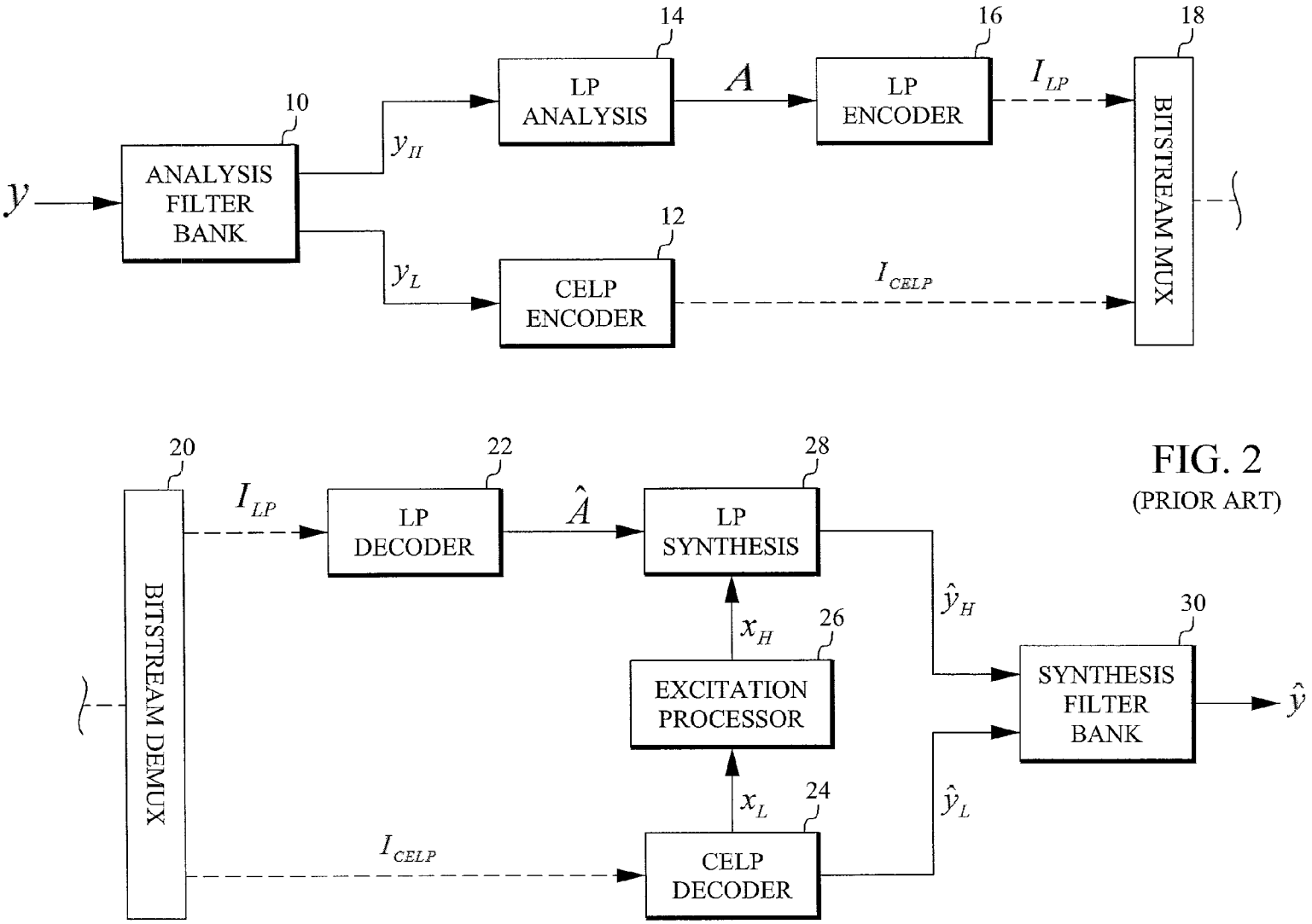
FIG. 2 (PRIOR ART)
FIG. 2 illustrates an example BWE system with a CELP codec for the low band and where the upper band is reconstructed using a Linear Predictor (LP) envelope and an excitation signal which is generated from modified output parameters of the CELP decoder.

The proposed technology may be used both in time domain BWE and frequency domain BWE. Example embodiments for both will be given below, Time Domain BWE An example embodiment of a prior art BWE mainly intended for speech applications is shown in FIG. 2. This example uses a CELP speech encoding algorithm for the low band of the input signal. The high band envelope is represented with an LP filter. The synthesis of the high band is created by using a modified version of the low band excitation signal extracted from the CELP synthesis.

Each input signal frame y is split into a low frequency band signal $y_L$ and a high frequency band signal $y_H$ using an analysis filter bank 10. Any suitable filter bank may be used, but it would essentially consist of a low-pass and a high-pass filter, e.g. a Quadrature Mirror Filter (QMF) filter bank. The low band signal is fed to a CELP encoding algorithm performed in a CELP encoder 12. LP analysis is conducted on the high band signal in an LP analysis block 14 to obtain a representation A of the high band envelope. The LP coefficients defining A are encoded with an LP quantizer or LP encoder 16, and the quantization indices $I_{LP}$ are multiplexed in a bitstream mux (multiplexer) 18 together with the CELP encoder indices $I_{CELP}$ to be stored or transmitted to a decoder. The decoder in turn demultiplexes the indices $I_{LP}$ and $I_{CELP}$ in a bitstream demux (de-multiplexer) 20, and forwards them to the LP decoder 22 and the CELP decoder 24, respectively. In the CELP decoding the CELP excitation signal $x_L$ is extracted and processed such that the frequency spectrum is modulated to generate the high band excitation signal $x_H$.

There exists a variety of modulation schemes to create a high band excitation $x_H$ from a low band excitation signal $x_L$ in an excitation processor 26. For example, reversing the spectrum guarantees that the properties of the signal are similar in the crossover region between low band and high band, but the high end of the high band signal may have undesired properties. Other ways of generating a high band excitation is to perform other types of modulation which may or may not preserve the harmonic structure of a series of harmonics. The excitation signal may be taken from only a part of the low band or even adaptively by searching the low band for suitable parts to be used to form the high band excitation signal. The latter approach may also require that parameters are encoded such that the decoder may identify the regions used in the high band excitation.

The modulated excitation $x_H$ is filtered using the high band LP filter $1/\hat{A}$ to form the high band synthesis $\hat{y}_H$. This is done in an LP synthesis block 28. The output $\hat{y}_L$ of the CELP decoder is joined with the high band synthesis $\hat{y}_H$ in synthesis filter bank 30 to form the output signal $\hat{y}$.

In FIG. 2 and the following figures the lines to and from the bitstream mux 18 and bitstream demux 20, respectively, have been dashed to indicate that they transfer indices representing quantized quantities rather than the actual values of the quantized quantities.

Figure 3:
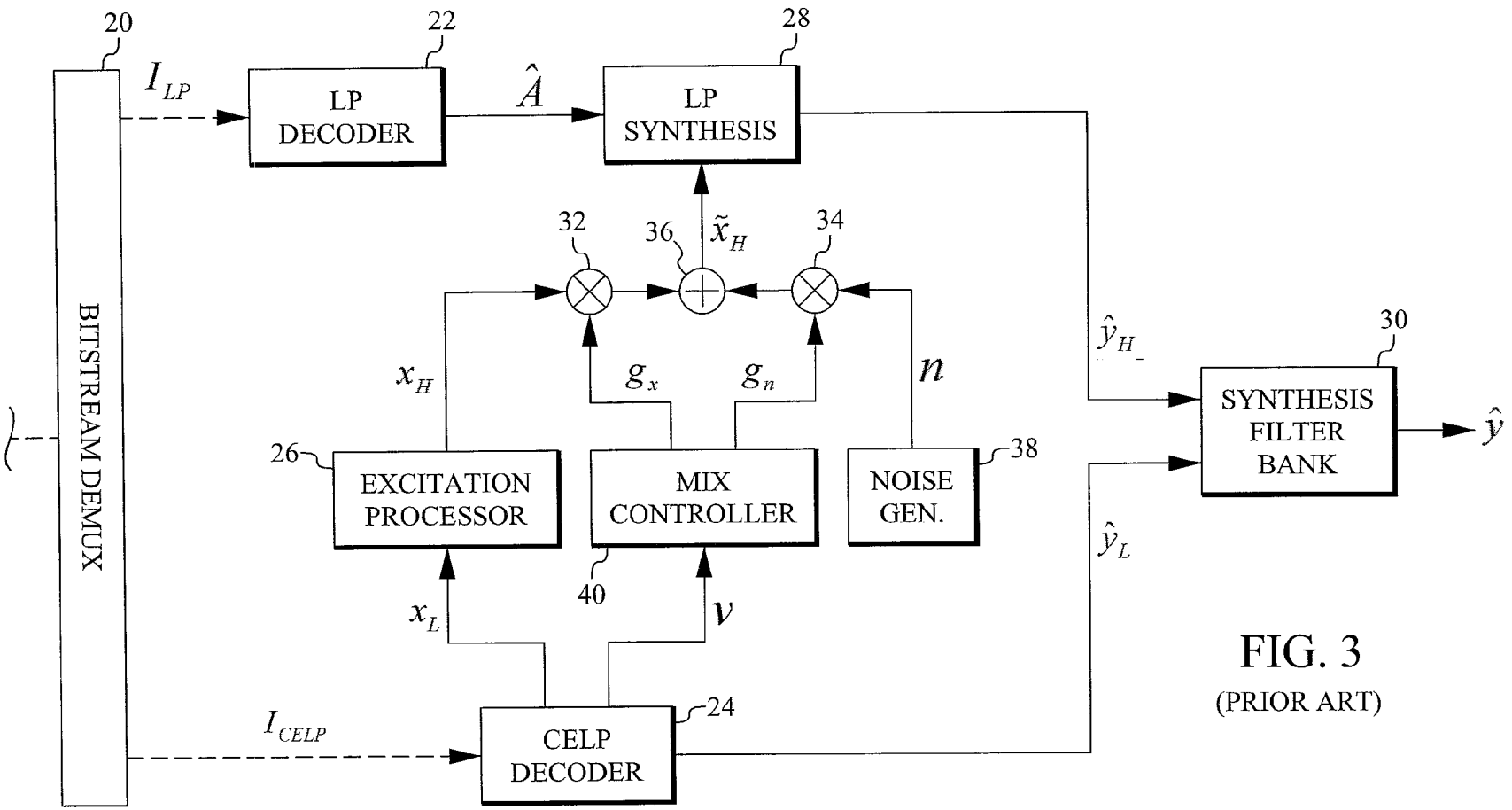
FIG. 3 (PRIOR ART)
FIG. 3 illustrates an example BWE decoder which has a corresponding encoder as shown in FIG. 2. The modulated excitation is mixed with a noise signal from a noise generator.

The excitation from the low band may have properties that are not suitable to be used as high band excitation. For instance, the low band signal often contains strong harmonic structure which gives annoying artifacts when transferred to the high band. One prior art solution to control the excitation structure is to mix the low band excitation signal with noise. An example decoder of such a system is shown in FIG. 3. Here, the high band LP filter coefficients $\hat{A}$ are decoded and the CELP decoder 24 is run while extracting the excitation signal just as described in FIG. 2. However, the modulated excitation $x_H$ is also mixed, as illustrated by multipliers 32, 34 and an adder 36, with a Gaussian noise signal n from a noise generator 38 using respective mixing factors $g_x(i)$ and $g_n(i)$ for each subframe i, i.e.:

$$\tilde{x}_i = g_x(i)x_{H,i} + g_n(i)n_i \tag{1}$$

Here $x_{H,i}$ represents the samples $x_H$ of subframe i, such that $x_H = [x_{H,1}\ x_{H,2}\ \ldots\ x_{H,Nsub}]$, where Nsub is the number of subframes. In this example Nsub=4. It may further be beneficial to adapt the temporal shape of the noise signal n such that it matches the temporal shape of $x_H$.

In this example the mixing factors are determined in a mix controller 40 and are based on a voicing parameter v(i) of each subframe i of the CELP codec:

$$\begin{cases} g_x(i) = \sqrt{v(i)} \\ g_n(i) = \sqrt{E_1(1 - v(i))/E_2} \end{cases} \tag{2}$$

where $E_1$ and $E_2$ are the frame energies of $x_H$ and n, respectively, i.e.:

$$\begin{cases} E_1 = \sum_{k=0}^{L-1} x_H^2(k) \\ E_2 = \sum_{k=0}^{L-1} n^2(k) \end{cases} \tag{3}$$

where the current frame is represented with samples k=0, 1, 2, . . . , L−1. The voicing parameter v(i) influences the balance of the noise component n and the modulated excitation $x_H$ and may e.g. be in the interval v(i)∈[0,1]. The voicing parameter expresses the signal periodicity (or tonality or harmonicity) and is computed from the energy $E_{ACB}$ of the algebraic codebook and the energy $E_{FCB}$ of the fixed codebook of the CELP codec, for example in accordance with:

$$v(i) = 0.5(1 - r_v(i)) \tag{4}$$

where $$r_v(i) = \frac{E_v(i) - E_C(i)}{E_v(i) + E_C(i)} \tag{5}$$

where $E_v(i)$ and $E_C(i)$ are the energies of the scaled pitch code vector and scaled algebraic code vector for subframe i.

The mixed excitation $\tilde{x}_H$ is filtered in LP synthesis block 28 using the high band LP filter 1/Â to form the high band synthesis $\hat{y}_H$. The output $\hat{y}_L$ of the CELP decoder is joined with the high band synthesis $\hat{y}_H$ in synthesis filter bank 30 to form the output signal ŷ.

An example embodiment of a time domain BWE based on the technology proposed herein focuses on an audio encoder and decoder system mainly intended for speech applications. This embodiment resides in the decoder of an encoding and decoding system as outlined in FIG. 2 and with an excitation noise mixing system as described in FIG. 3. The addition to the prior art systems is an additional control on both the spectral envelope and the excitation mixing by jointly controlling envelope shape and excitation noisiness with a common control (or shared) parameter f, as exemplified in the decoder 200 in FIG. 4. The control parameter f is "common" in the sense that the same control parameter f is used to control both envelope shape and excitation noisiness. In this example a single control parameter f∈[0,1] is used. It should, however, be noted that any interval of the control parameter may be used, e.g. [−A,A], [0,A], [A,0] or [A,B] for any suitable A and B. However, there is a benefit of having a simple unit interval for the purpose of controlling two or more processes jointly.

The control of the spectral envelope may, for example, be done using a formant post-filter H(z) (illustrated at 42 in FIG. 4) of the form:

$$H(z) = \frac{\hat{A}(z/\gamma_1)}{\hat{A}(z/\gamma_2)} \tag{6}$$

where

Â is a linear predictor filter representing the envelope, and $\gamma_1$, $\gamma_2$ are functions of the control parameter f.

Figure 5:
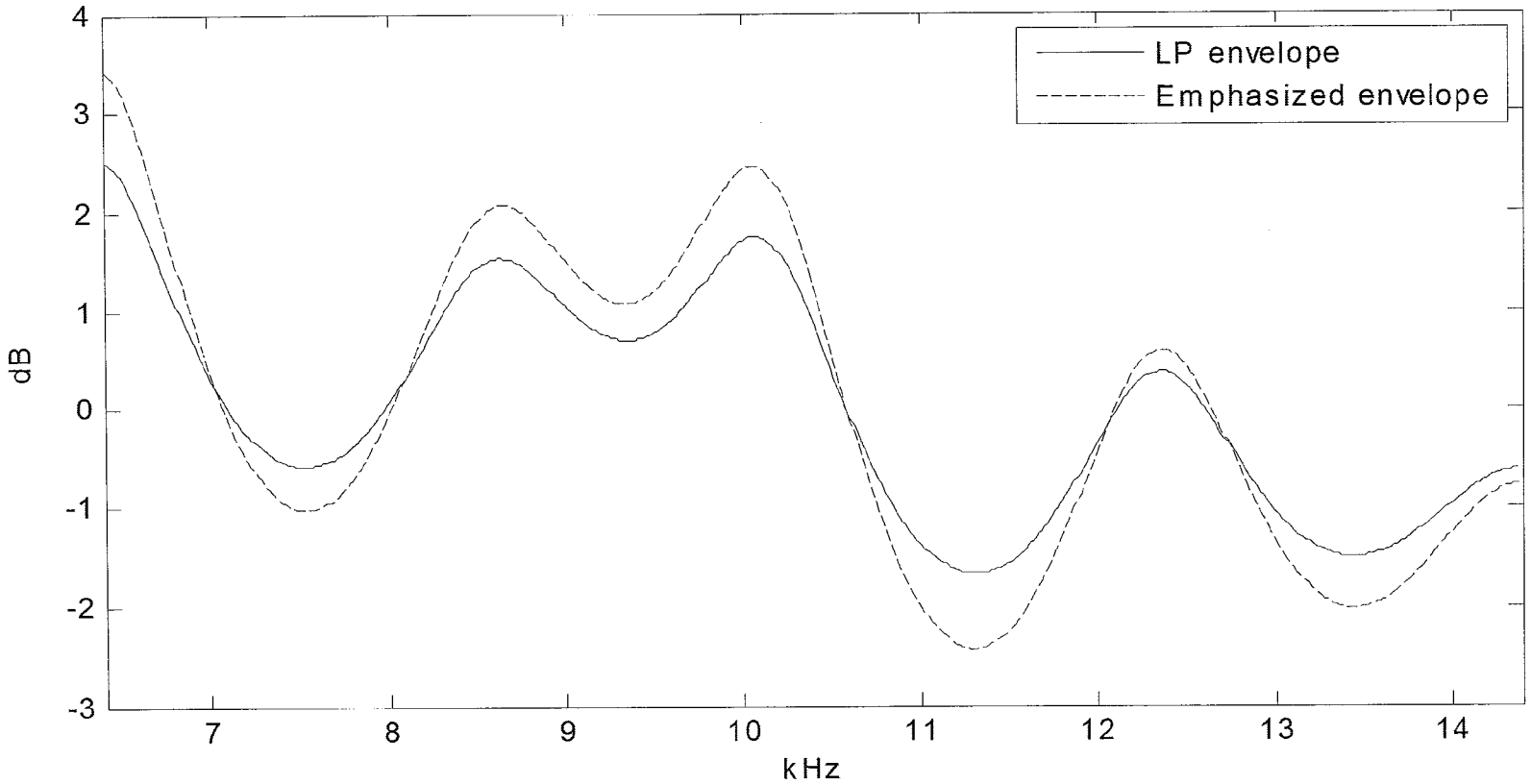
FIG. 5 illustrates an example of an input LP spectrum and an LP spectrum which has been emphasized with a post-filter.

This post-filter 42 is typically used for cleaning spectral valleys in a CELP decoder, and is controlled by a joint post-filter and excitation controller 44. An example of the spectrum envelope emphasis obtained with such a post-filter can be seen in FIG. 5. In this example embodiment the filter 42 is made adaptive by modifying $\gamma_1$, $\gamma_2$ using the control parameter f in accordance with:

$$\begin{cases} \gamma_1 = \gamma_0 + f \cdot \Delta\gamma \\ \gamma_2 = \gamma_0 - f \cdot \Delta\gamma \end{cases} \tag{7}$$

where $\gamma_0$, Δγ are predetermined constants. Suitable values for $\gamma_0$ may be $\gamma_0$=0.75 or in the range $\gamma_0$∈[0.5,0.9], and suitable values for Δγ may be Δγ=0.15 or in the range Δγ∈[0.1,0.3]. Note however that $\gamma_0$ and Δγ must be chosen such that $\gamma_1$∈[0,1] and $\gamma_2$∈[0,1]. With this setup, the control value f=1 will give the strongest modification from the post-filter while f=0 will disable the post-filter by setting $\gamma_1$=$\gamma_2$ which yields H(z)=1.

In another variant of the post-filter 42 the idle state of the filter for f=0 is modified to have a flattening effect on the spectrum. This may be useful for situations where the initial spectrum has too much structure, such that a disabling of the post-filter is not enough to achieve the desired amount of spectral valley de-emphasis. In that case the expression in equation (7) can be modified as:

$$\begin{cases} \gamma_1 = \gamma_0 - \gamma_{exp} + f \cdot \Delta\gamma \\ \gamma_2 = \gamma_0 + \gamma_{exp} - f \cdot \Delta\gamma \end{cases} \tag{8}$$

or $$\begin{cases} \gamma_1 = \gamma_0 - \gamma_{exp} + f \cdot (\Delta\gamma + \gamma_{exp}) \\ \gamma_2 = \gamma_0 + \gamma_{exp} - f \cdot (\Delta\gamma + \gamma_{exp}) \end{cases} \tag{9}$$

where the equation (9) implicitly accounts for the flattening filter offset. Note that f=0 in this case generates $\gamma_1$<$\gamma_2$ which means the post-filter 42 has a flattening effect rather than emphasizing effect on the shape of the envelope.

The flattening effect may also be achieved by extending the range of the control parameter f to e.g. f∈[−1,1] or f∈[A, A] or f∈[A, B] for suitable values of A and B. In this case, the post-filter 42 may be expressed as in equation (7) such that a negative f gives a flattening effect to the spectral envelope while a positive f enhances the spectral envelope structure. It may also be desirable to use different post-filter strengths for the spectral structure emphasis and spectral flattening, respectively. One such method would be to use a different Δγ depending on the sign of the control parameter f.

$$\begin{cases} \gamma_1 = \gamma_0 + f \cdot \Delta\gamma_{sharp} \\ \gamma_2 = \gamma_0 - f \cdot \Delta\gamma_{sharp} \end{cases}, f \geq 0 \tag{10}$$

$$\begin{cases} \gamma_1 = \gamma_0 + f \cdot \Delta\gamma_{flat} \\ \gamma_2 = \gamma_0 - f \cdot \Delta\gamma_{flat} \end{cases}, f < 0$$

where $\Delta\gamma_{flat}$ and $\Delta\gamma_{sharp}$ are predetermined constants which control the strength of the flattening and spectral enhancing strength, respectively. Suitable values may be $\Delta\gamma_{flat}=0.12$ or in the range $\Delta\gamma_{flat}\in[0.01,0.20]$ and $\Delta\gamma_{sharp}=0.08$ or in the range $\Delta\gamma_{sharp}\in[0.01,0.20]$.

The excitation mixing is in turn controlled by a mix controller 41 configured to control the excitation noisiness by mixing the high band excitation $x_{H,i}$ of subframe i with noise $n_i$ in accordance with (1), where the mixing factors $g_x(i)$ and $g_n(i)$ are defined by:

$$\begin{cases} g_x(i) = \sqrt{v(i)(1-\alpha f)} \\ g_n(i) = \sqrt{E_1(1-v(i)(1-\alpha f))/E_2} \end{cases} \tag{11}$$

where

- $v(i)$ is a voicing parameter partially controlling the excitation noisiness,
- $\alpha$ is a predetermined tuning constant,
- $E_1$ is the frame energy of the high band excitations $x_{H,i}$ for all subframes i, and
- $E_2$ is the frame energy of the noise $n_i$ for all subframes i.

The tuning constant $\alpha$ decides the maximum modification compared to equation (2). A suitable value for $\alpha$ may be $\alpha=0.3$ or in the range $\alpha\in[0,1]$. When the control parameter f is close to 1 the mixing factors will be balanced to give more noise, while f close to 0 will give the unmodified noise proportion in the mix.

If negative values of the control parameter f are permitted, an alternative expression for the noise mixing factors generated by mix controller 41 is $$\begin{cases} g_x(i) = \sqrt{v(i)(1-\max(0,\alpha f))} \\ g_n(i) = \sqrt{E_1(1-v(i)(1-\max(0,\alpha f)))/E_2} \end{cases} \tag{12}$$

where

- $v(i)$ is a voicing parameter partially controlling the excitation noisiness,
- $\alpha$ is a predetermined tuning constant,
- $E_1$ is the frame energy of the high band excitations $x_{H,i}$ for all subframes i, and
- $E_2$ is the frame energy of the noise $n_i$ for all subframes i.

Here the function max(a,b) returns the maximum value of a and b as defined in equation (14) below. In the expression above this ensures that a negative f does not influence the noise mixing values.

In an embodiment the control parameter f may be adapted by using parameters already present in the decoder 200. One example is to use the spectral tilt of the high band signal, since the post-filter 42 may be harmful in combination with a strong spectral tilt. Thus, the joint post-filter and excitation controller 44 may be configured adapt the control parameter f to a high band spectral tilt $t_m$ of frame m. The high band spectral tilt may be approximated using the second coefficient $a_{1,m}$ of the decoded LP filter $\hat{A}_m=\{1, a_{1,m}, a_{2,m}, \ldots, a_{P,m}\}$ of the current frame m, where P is the filter order.

It is generally beneficial to smoothen the adaptation to avoid creating abrupt changes in the spectral envelope, for example in accordance with:

$$t_m=\beta\cdot a_{1,m}+(1-\beta)\max(0,t_{m-1}) \tag{13}$$

where $t_m$ is the spectral tilt value of frame m, $t_{m-1}$, is the spectral tilt value of the previous frame m−1 and $\beta=0.1$ or in the range $\beta=[0,0.5]$. The max function may be defined as:

$$\max(a,b) = \begin{cases} a, & a \geq b \\ b, & a < b \end{cases} \tag{14}$$

Here the max function ensures the spectral tilt value used from the previous frame is not negative. Other examples for smoothing the spectral tilt are:

$$t_m=\beta\cdot\max(0,a_{1,m})+(1-\beta)t_{m-1} \tag{15}$$

and $$t_m=\beta\cdot a_{1,m}+(1-\beta)t_{m-1} \tag{16}$$

It may also be desirable to consider both negative and positive spectral tilts. In this case the absolute value of the spectral tilt approximation may be used, i.e.:

$$t_m=\beta\cdot|a_{1,m}|+(1-\beta)t_{m-1} \tag{17}$$

The smoothened spectral tilt value can be mapped to the control parameter f with a piece-wise linear function:

$$f(t_m) = \begin{cases} 0, & t_m \geq C_{max} \\ 1-(t_m-C_{min})/(C_{max}-C_{min}), & C_{min} \leq t_m < C_{max} \\ 1, & t_m < C_{min} \end{cases} \tag{18}$$

where $C_{min}$ and $C_{max}$ are predetermined constants. In this example the constant values are set to $C_{max}=0.8$ and $C_{min}=0.4$, but other suitable values may be chosen from $C_{max}\in[0.5,2.0]$ and $C_{min}\in[0,C_{max}]$.

Returning to FIG. 4, using the modified $g_x$ and $g_n$ a new excitation signal $\tilde{x}_H$ is obtained. This signal is filtered using the high band LP filter $1/\hat{A}$ (at 28) to form a first stage high band synthesis $y'_H$. This signal is fed to the adaptive post-filter H(z) (at 42) to obtain the high band synthesis $\tilde{y}_H$. The output $\hat{y}_L$ of the CELP decoder 24 is combined with the high band synthesis $\tilde{y}_H$ in the synthesis filter bank 30 to form the output signal $\hat{y}$.

Other alternatives exist to the tilt-based adaptation described above. For example, a measure of the spectral flatness of the high band may be used. The spectral flatness $\phi$ is measured on some representation of the high band spectrum. It may, for example, be derived from the high band LPC coefficients A using the well-known expression:

$$\varphi = \frac{e^{\frac{1}{N}\sum_{i=0}^{N-1}\log(X_i)}}{\frac{1}{N}\sum_{i=0}^{N-1}X_i} \tag{19}$$

where $$X_i = \frac{1}{|DFT(A,M)|^2},\ i=0,1,2,\ldots,N-1 \tag{20}$$

where DFT(A,M) denotes the discrete Fourier transform of length M of the LPC coefficients A. The expression $|\cdot|$ denotes the magnitude of the complex transform values (the dot represents a mathematical expression), and due to the symmetry of the transform only the first N=M/2 values are considered. This transform is preferably implemented with an FFT (Fast-Fourier Transform) and the M would be the nearest higher power of 2 to the filter length P+1, i.e. $M=2^{\lceil \log_2(P+1)\rceil}$.

Figure 4:
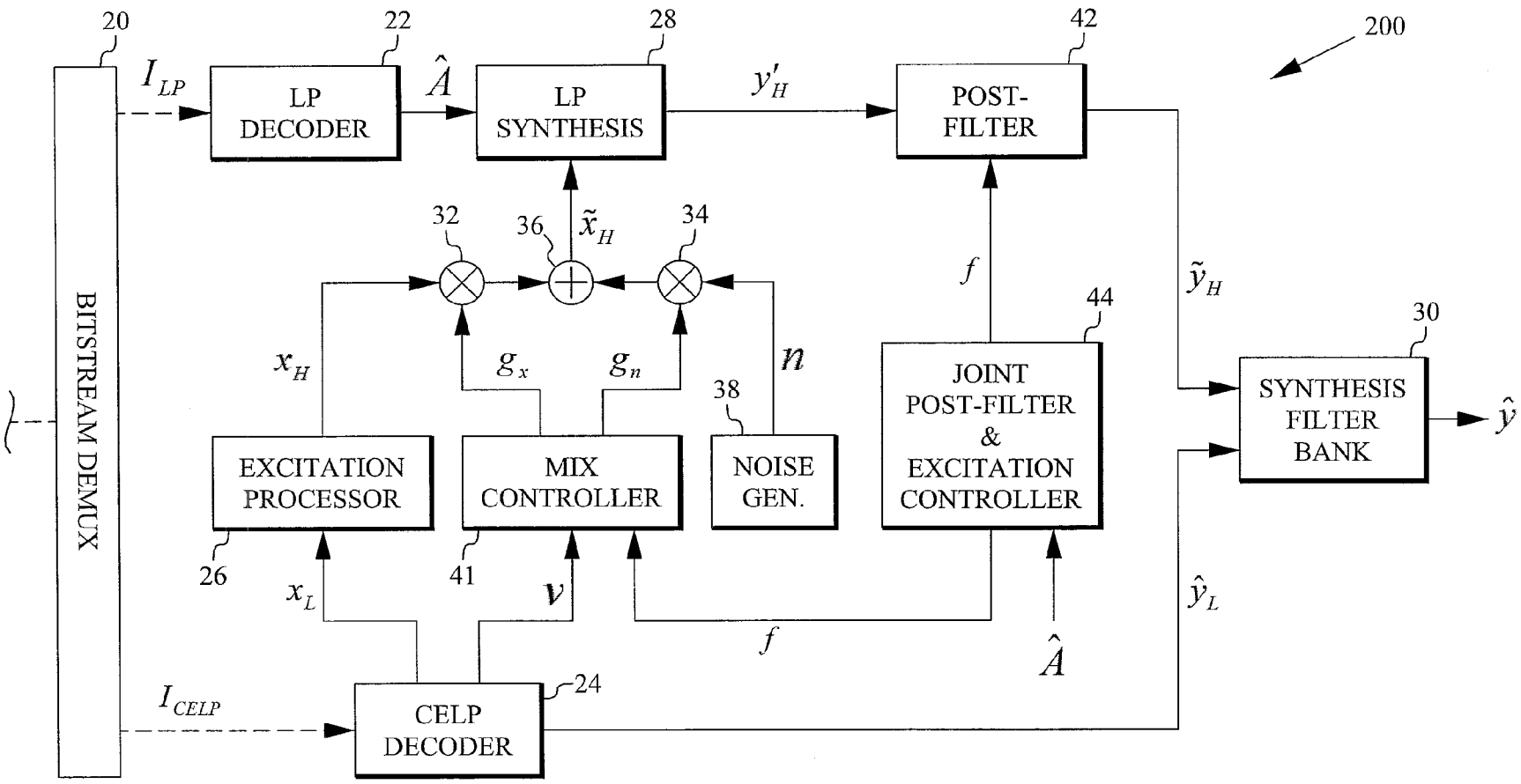
FIG. 4 illustrates an example embodiment of the proposed technology in a CELP decoder system with a joint control arrangement for the excitation mixing and spectral shape.

If P+1>M, the input filter A is padded with zeroes before the FFT is performed. The spectral flatness $\phi$ may also be calculated using the quantized LPC coefficients $\hat{A}$. If this is done, the spectral flatness measure may be calculated in the decoder without additional signaling. In this case the system can be described by FIG. 4, provided that A is substituted with $\hat{A}$ in equation (20).

Figure 6:
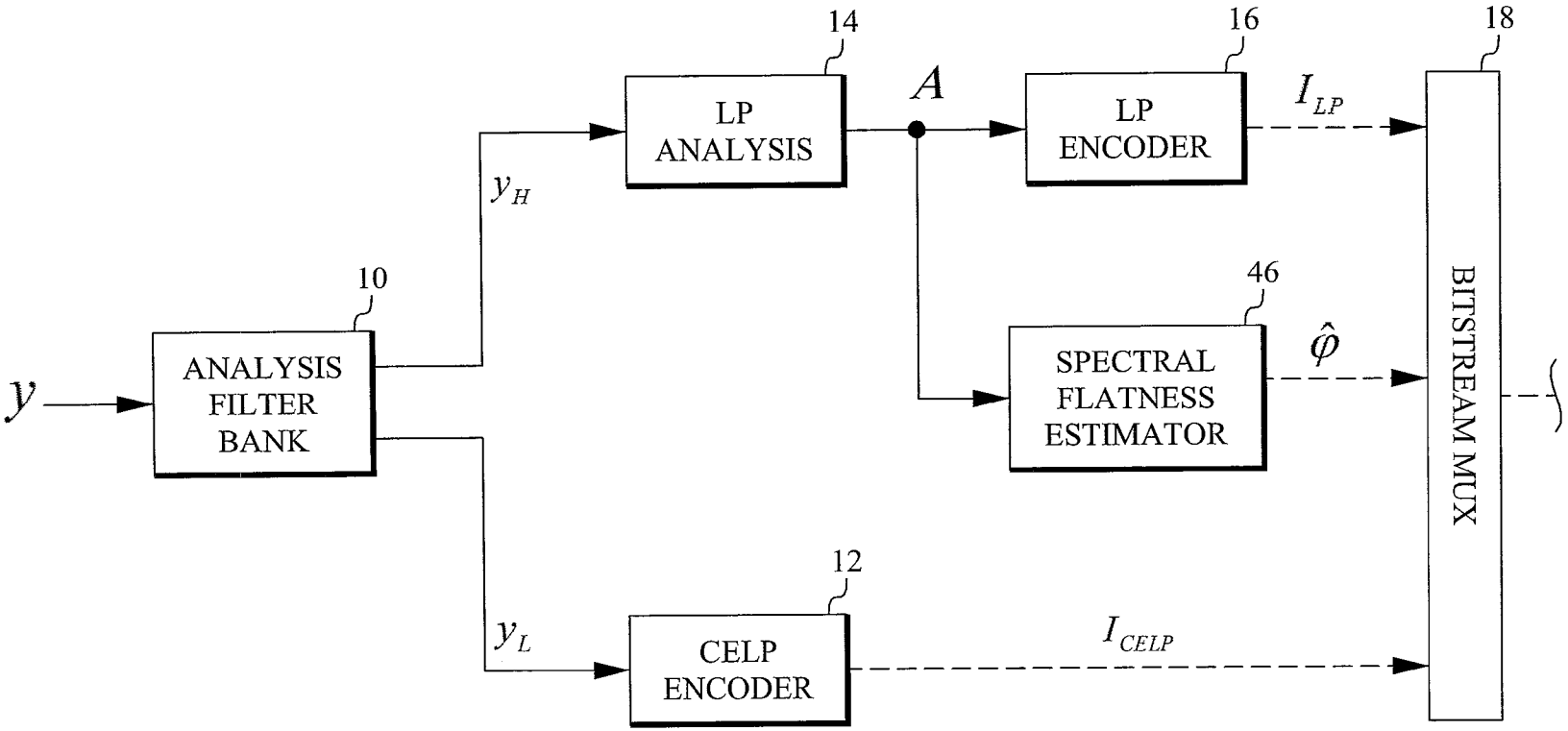
FIG. 6 illustrates an example embodiment of an encoder using a spectral flatness analysis based on Linear Predictive Coding (LPC) coefficients.

It may be desirable to determine the spectral flatness measure on the encoder side to reduce the overall complexity when considering both encoder and decoder. In such an embodiment the encoder includes a spectral flatness estimator configured to determine, for transmission to a decoder, a measure of spectral flatness of the high band signal. An encoder using a spectral flatness estimator 46 based on the LPC coefficients is depicted in FIG. 6. In this case, the flatness measure must be signaled in the bit-stream. The signaling may consist of a binary decision $\hat{\phi}\epsilon\{0,1\}$ whether the spectral flatness is considered high or low depending on a threshold value $\phi_{thr}$.

$$\begin{cases} \hat{\varphi} = 0, & \varphi \geq \varphi_{thr} \\ \hat{\varphi} = 1, & \varphi < \varphi_{thr} \end{cases} \tag{21}$$

The corresponding control parameter f may, for example, be derived using the binary decision $\hat{\phi}$, i.e. $f=1-2\hat{\phi}$.

With the above definitions, the control parameter f will be 1 for flatness values above the threshold and −1 for flatness values below the threshold. To limit the influence of the abrupt switching between these values, the control parameter may further be smoothened using e.g. a forgetting factor β in a similar way as for the tilt filtering:

$$f'_m = \beta \cdot f_m + (1-\beta) \cdot f'_{m-1} \tag{22}$$

Figure 7:
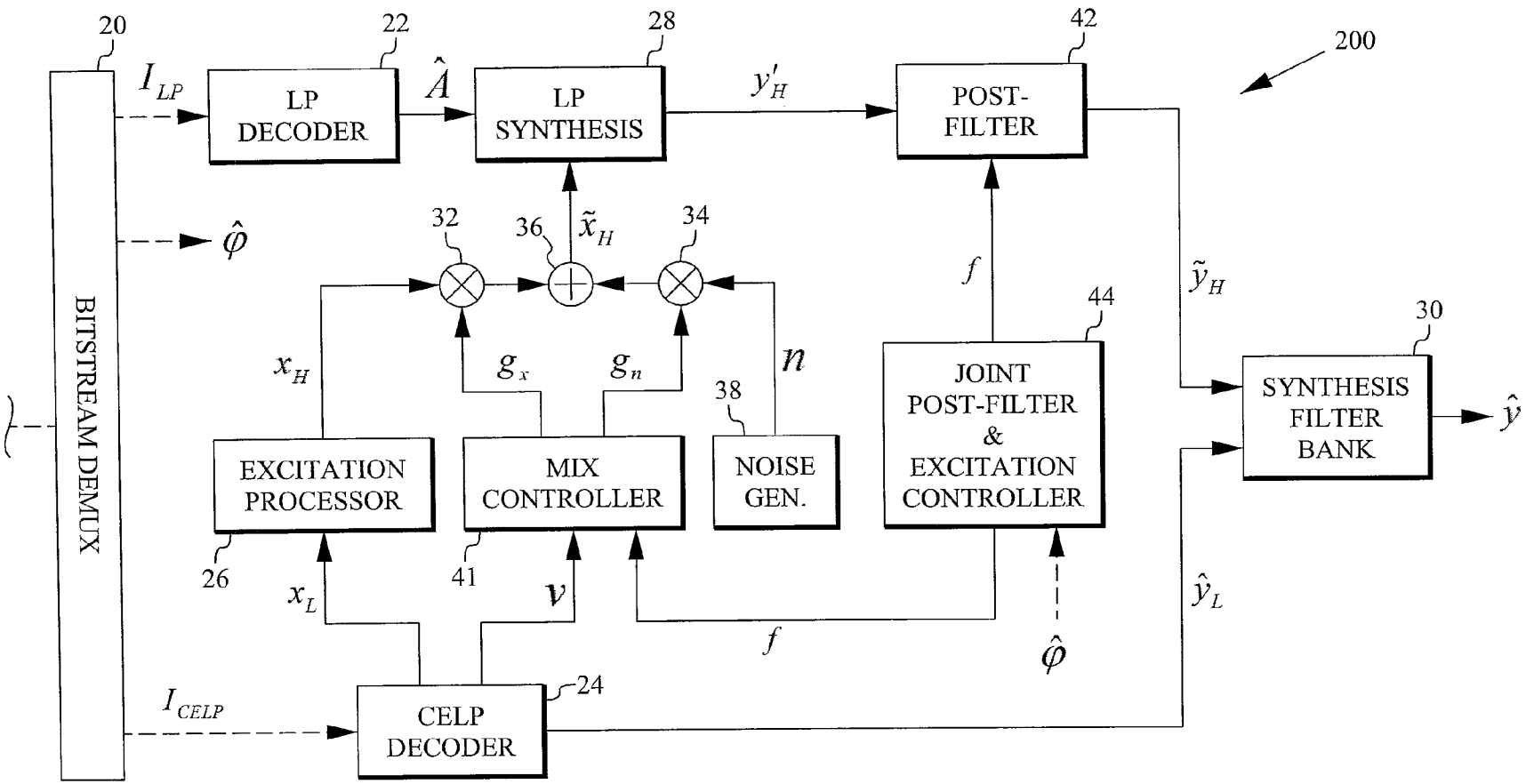
FIG. 7 illustrates an example embodiment of a decoder corresponding to the encoder in FIG. 6 which uses the transmitted flatness parameter for joint spectral envelope and excitation structure control.

A decoder 200 corresponding to the encoder in FIG. 6 is shown in FIG. 7. It is similar to the decoder in FIG. 4. However, in FIG. 7 the joint post-filter and excitation controller 44 determines the control parameter f based on the received binary decision $\hat{\phi}$ instead of the linear predictor filter $\hat{A}$ representing the envelope. Generally, the control parameter f is adapted to a measure of spectral flatness (ϕ) of the high band.

It should be noted that other processing stages may be possible before the synthesis filter $1/\hat{A}$ or before or after the post-filter H(z). One such processing stage could be a temporal shaping procedure which aims to reconstruct the temporal structure of the original high band signal. Such temporal shaping may be encoded using a gain-shape vector quantization representing gain correction factors on a subframe level. Part of the temporal shaping will also be inherited from the low band excitation signal which is partly used as a base for the high band excitation signal.

The post-filter and excitation mixing may also affect the energy of the signals. Keeping the energy stable is desirable and there are many available methods for handling this. One possible solution is to measure the energy before and after the modification and restore the energy to the value before excitation mixing and post-filtering. The energy measurement may also be limited to a certain band or to the higher energy regions of the spectrum, allowing energy loss in the valleys of the spectrum. In this example embodiment energy compensation may be used as an integral part of the mixing and post-filter functions.

Frequency Domain BWE

Figure 8:
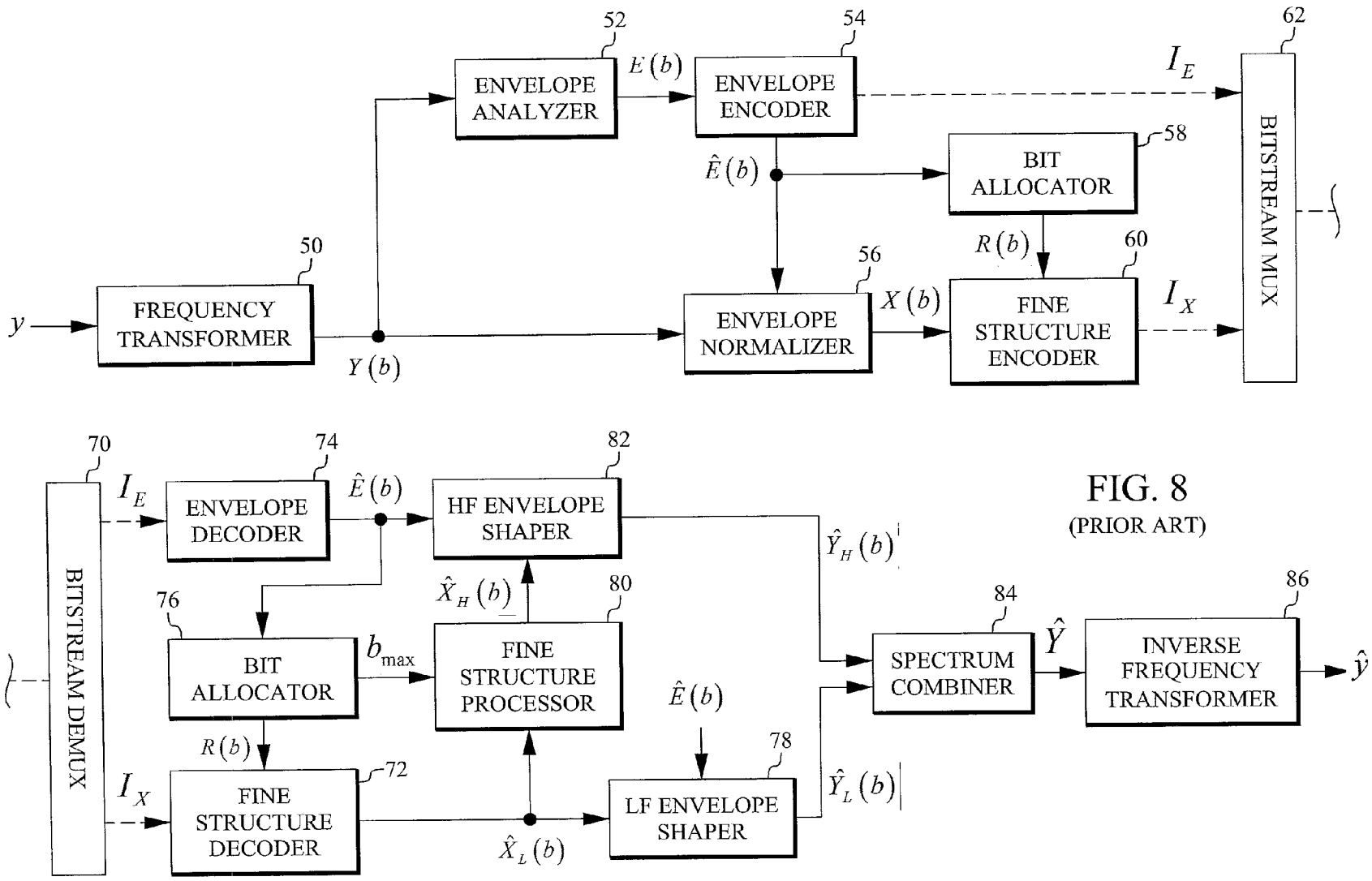
FIG. 8 (PRIOR ART)
FIG. 8 illustrates an example of a transform based audio codec which has a joint envelope encoding for the entire spectrum and employs BWE techniques to obtain the spectral fine structure of the high band.

Frequency transform based audio coders are often used for general audio signals such as music or speech with background noises or reverberation. At low bitrates they generally show poor performance. One common prior art solution is to lower the bandwidth to obtain acceptable quality for a narrower band and apply BWE for the higher frequencies. An overview of such a system is shown in FIG. 8.

The input audio is first partitioned into time segments or frames as a preparation step for the frequency transform. Each frame y is transformed to frequency domain to form a frequency domain spectrum Y. This may be done using any suitable transform, such as the Modified Discrete Cosine Transform (MDCT), the Discrete Cosine Transform (DCT) or the Discrete Fourier Transform (DFT). The frequency spectrum is partitioned into shorter row vectors denoted Y(b). These functions are performed by a frequency transformer 50. Each vector now represents the coefficients of a frequency band b out of a total number of bands $N_b$. From a perceptual perspective is beneficial to partition the spectrum using a non-uniform band structure which follows the frequency resolution of the human auditory system. This generally means that narrow bandwidths are used for low frequencies while larger bandwidths are used for high frequencies.

Next, the norm of each band is calculated in an envelope analyzer 52 to form a sequence of gain values E(b) which form the spectral envelope. These values are then quantized using an envelope encoder 54 to form the quantized envelope $\hat{E}(b)$. The envelope quantization may be done using any quantizing technique, e.g. differential scalar quantization or any vector quantization scheme. The quantized envelope coefficients $\hat{E}(b)$ are used to normalize the band vectors Y(b) in an envelope normalizer 56 to form corresponding normalized shape vectors X(b):

$$X(b) = \frac{1}{\hat{E}(b)} Y(b) \tag{23}$$

The sequence of normalized shape vectors X(b) constitutes the fine structure of the spectrum. The perceptual importance of the spectral fine structure varies with the frequency but may also depend on other signal properties such as the spectral envelope signal. Transform coders often employ an auditory model to determine the important parts of the fine structure and assign the available resources to the most important parts. The spectral envelope is often used as input to this auditory model and the output is typically a bit assignment for the each of the bands corresponding to the envelope coefficients. Here, a bit allocation algorithm in a bit allocator 58 uses the quantized envelope $\hat{E}(b)$ in combination with an internal auditory model to assign a number of bits R(b) which in turn are used by a fine structure encoder 60. When the transform coder is operated at low bitrates, some of the bands will be assigned zero bits and the corresponding shape vectors will not be quantized. The indices $I_E$ and $I_X$ from the quantization of the envelope and the encoded fine structure vectors, respectively, are multiplexed in a bitstream mux (multiplexer) 62 to be stored or transmitted to a decoder.

The decoder demultiplexes the indices from the communication channel or the stored media in a bitstream demux (de-multiplexer) 70 and forwards the indices $I_X$ to a fine structure decoder 72 and $I_E$ to an envelope decoder 74. The quantized envelope $\hat{E}(b)$ is obtained and fed to the bit allocation algorithm in a bit allocator 76 in the decoder, which generates the bit allocation R(b). Using R(b), the band with the highest non-zero value in the bit allocation is found. This band is denoted $b_{max}$.

The fine structure decoder 72 uses the fine structure indices $I_X$ and the bit allocation R(b) to produce the quantized fine structure vectors $\hat{X}_L$ (b), which are defined for b=1, 2, . . . , $b_{max}$.

In this example embodiment the crossover frequency is adaptive depending on the bit allocation and starts from the band $b_{max}+1$, given the constraint that $b_{max}+1 \leq N_b$.

There may be bands $b<b_{max}$ which have zero bits assigned. In particular for low bitrates it is common that such zero-bit bands appear and due to variations in the spectrum the positions of the zero-bit bands usually vary from frame to frame. Such variations cause modulation effects in the synthesis. Typically the zero-bit bands are handled with spectral filling techniques, where signals are injected in the zero-bit bands. The filling signal may be a pseudo-random noise signal or a modified version of the coded bands. The filling technique is not an essential part of this technology and it is assumed that a suitable spectral filling is part of the fine structure decoder 72. After the spectral filling has been done, the low band fine structure $\hat{X}_L(b)$ is input to a low frequency envelope shaper 78, which restores the synthesized low band spectrum $\hat{Y}_L(b)$ in accordance with:

$$\hat{Y}_L(b)=\hat{X}_L(b)\cdot\hat{E}(b), b=1,2,\ldots b_{max} \tag{24}$$

The low band fine structure $\hat{X}_L$ (b) is also input to a fine structure modifier or processor 80, which identifies the length of the low band structure from the parameter $b_{max}$ and creates a high band excitation signal $\hat{X}_H(b)$ defined for $b_{max}+1, b_{max}+2, \ldots, N_b$. There are many techniques for creating a high band excitation from the low band excitation. In this example embodiment, the upper half of the low band excitation is folded and duplicated to fill the high band excitation. Assume that $\hat{X}_{LH}$ represents the upper half of the low band excitation signal and that the function rev(.) reverses the elements of a vector. Then the sequence [rev($\hat{X}_{LH}$) $\hat{X}_{LH}$ rev($\hat{X}_{LH}$) $\hat{H}_{LH}$, . . . ] is repeated for as many times as needed to fill the high band excitation spectrum $\hat{X}_H(b)$, $b_{max}+1$, $b_{max}+2, \ldots, N_b$. The high band excitation signal is then input to a high frequency envelope shaper 82 to form the synthesized high band spectrum $\hat{Y}_H(b)$ in accordance with:

$$\hat{Y}(b)=\hat{X}_H(b)\cdot\hat{E}(b), b=b_{max}+1, b_{max}+2, \ldots, N_b \tag{25}$$

The synthesized low band spectrum $\hat{Y}_L(b)$ and the synthesized high band spectrum $\hat{Y}_H(b)$ are combined in a spectrum combiner 84 to form the synthesis spectrum $\hat{Y}(b)$, or $\hat{Y}$ with the band index omitted. The synthesis spectrum is input to the inverse frequency transformer 86 to form the output signal $\hat{y}$. In this process the necessary windowing and overlap-add operations that are connected with the frequency transform are also conducted.

Figure 9:
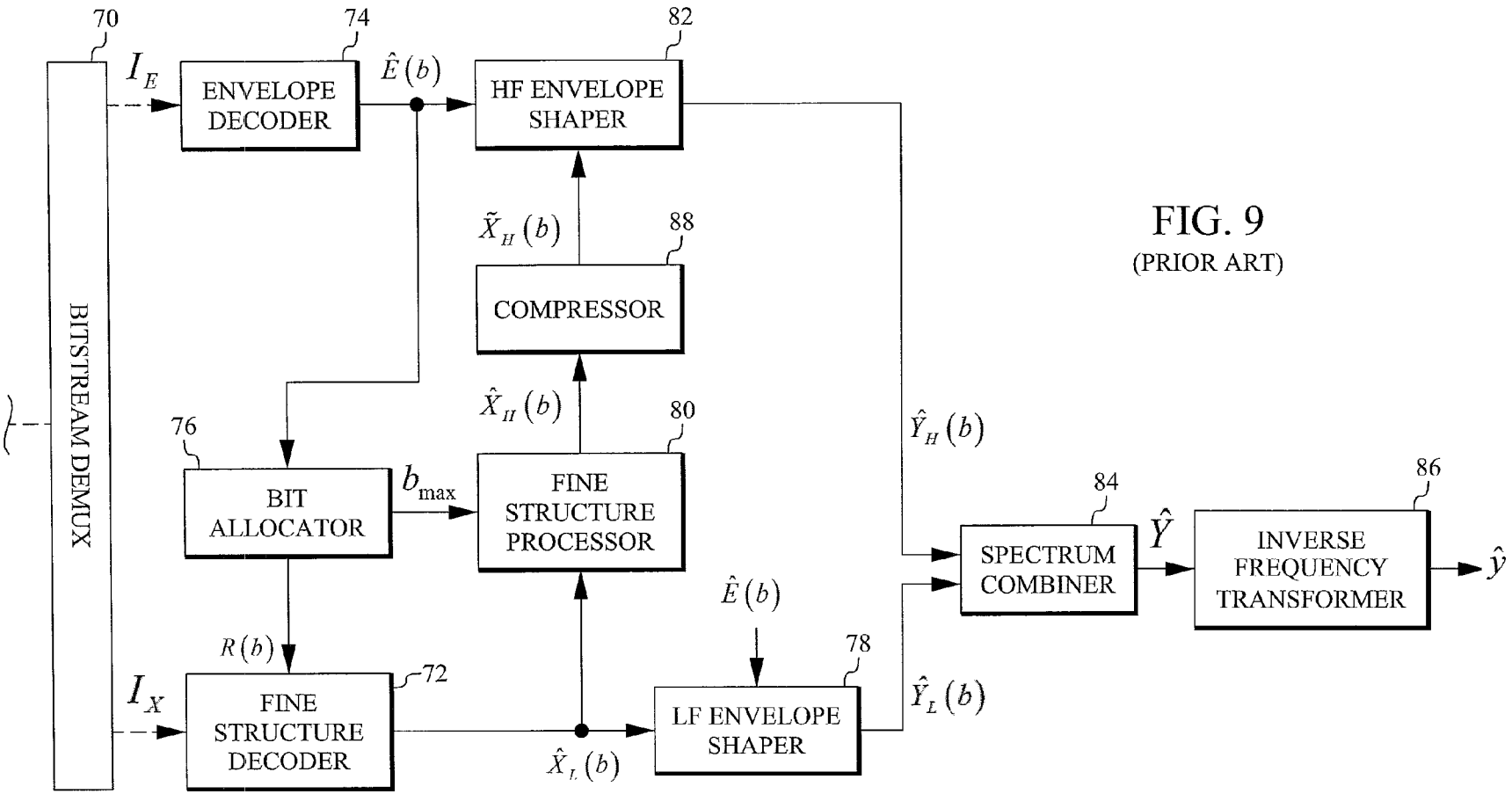
FIG. 9 (PRIOR ART)
FIG. 9 illustrates an example of a BWE decoder belonging to a corresponding encoder as shown in FIG. 8. The modulated excitation is modified using a compressor to get a flatter fine structure in the high band excitation.

As was the case of the time domain BWE, the excitation from the low band may have properties that are not suitable to be used as high band excitation. In particular, one may wish to flatten out some of the fine structure in the low band excitation. A decoder of such an example system is shown in FIG. 9. This prior art system assumes an encoder as outlined in FIG. 8. The addition to the described scheme there is a compressor H (at 88) which operates on the high band excitation signal $\hat{X}_H(b)$ to produce the compressed high band excitation signal $\tilde{X}_H(b)$. One example compressor function is:

$$H=\left(\frac{\max(|\hat{X}_H|)}{|\hat{X}_H|}\right)^{\eta} \tag{26}$$

which means H is a vector with the same length as $\hat{X}_H$. Here the band index b has been omitted and the vector represents all elements for the defined bands, i.e.:

$$\hat{X}_H=[\hat{X}_H(b_{max}+1)\hat{H}_H(b_{max}+2)\ldots\hat{X}_H(N_b)] \tag{27}$$

The compression factor $\eta$ is smaller than 1 and a suitable value may be $\eta=0.5$ or in the range $\eta\in[0.01,0.99]$, where values close to 0 give no effect and values close to 1 give maximum compression. The compressed high band synthesis is obtained by the element-wise multiplication of H and $\hat{X}_H$. It can be expressed as a matrix multiplication:

$$\tilde{X}_H=H\,\mathrm{diag}(\hat{X}_H) \tag{28}$$

where diag($\hat{X}_H$) produces a square matrix with $\hat{X}_H$ on the diagonal. The compressed high band excitation $\tilde{X}_H(b)$ is input to the high frequency envelope shaper 82 to form the high band spectrum $\hat{Y}_H(b)$ in accordance with:

$$\hat{Y}_H(b)=\tilde{X}_H(b)\cdot\hat{E}(b), b=b_{max}+1, b_{max}+2, \ldots, N_b \tag{29}$$

As illustrated in FIG. 9, the low band spectrum $\hat{Y}_L(b)$ and the high band spectrum $\hat{Y}_H(b)$ are combined in the spectrum combiner 84 to form the synthesis spectrum $\hat{Y}$ which is input to the inverse frequency transformer 86 to form the output signal $\hat{y}$.

An example embodiment of a frequency domain BWE based on the proposed technology focuses on an audio encoder and decoder system mainly intended for general audio signals. The new technology resides mainly in the decoder of an encoding and decoding system as outlined in FIG. 8 with an excitation compression system as illustrated in FIG. 9. An example embodiment of such a decoder 200 is illustrated in FIG. 10.

Figure 10:
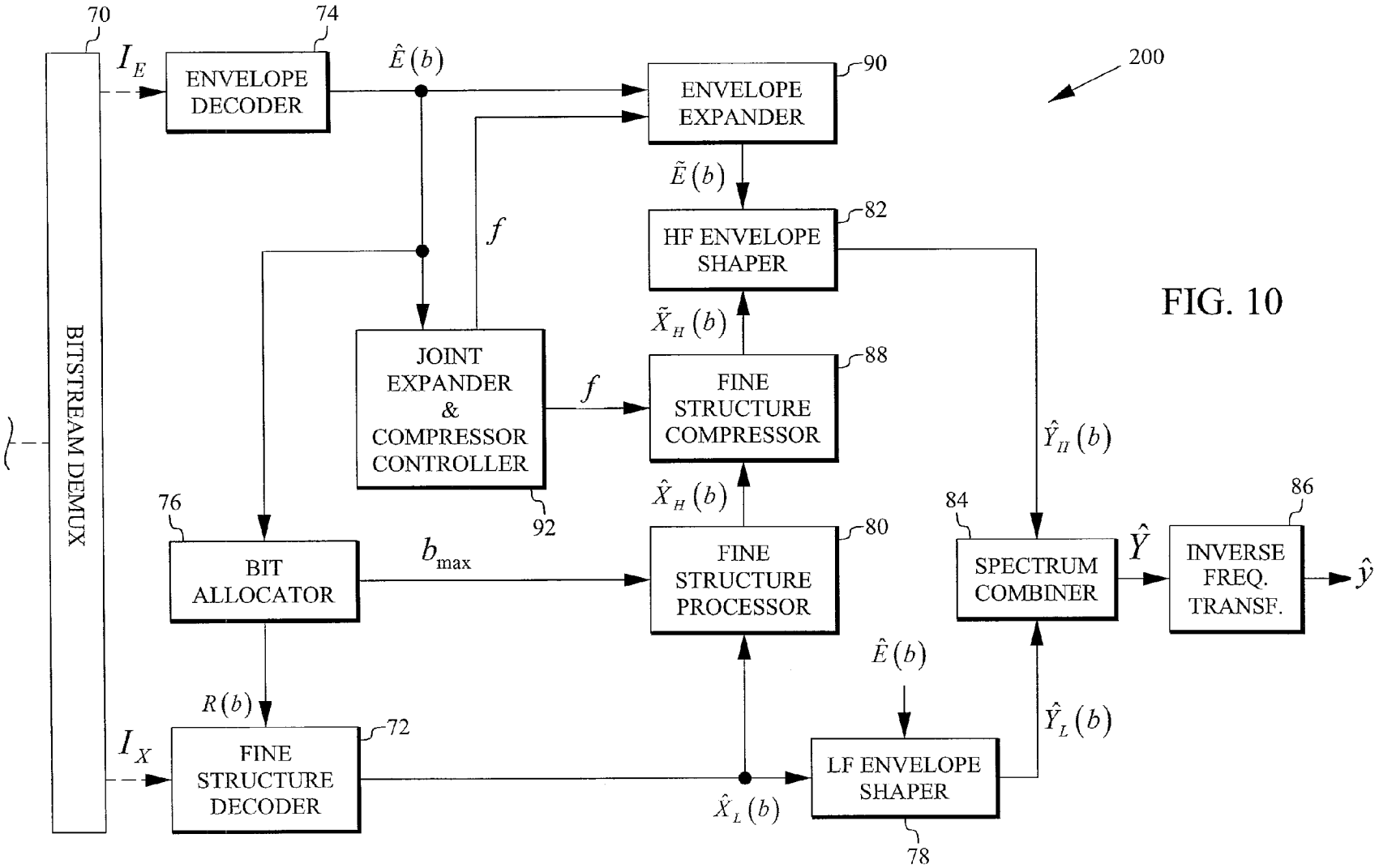
FIG. 10 illustrates an example embodiment of the proposed technology in a transform based decoder system with a joint controller for excitation compression and envelope expansion.

As an addition to the prior art there is provided a combined control of a high band excitation compression which is jointly controlled with a spectral envelope expander 90 as shown in FIG. 10. As in the time domain, a control parameter $f\in[0,1]$ is used for steering both the compressor 88 and the expander 90. This is performed by a joint expander and compressor controller 92.

The strength of the high band excitation compressor 88 is adapted using the control parameter f in accordance with:

$$H=\left(\frac{\max(|\hat{X}_H|)}{|\hat{X}_H|}\right)^{\eta+\Delta\eta\cdot f} \tag{30}$$

where $\Delta\eta$ gives the maximum compression factor exponent $\eta+\Delta\eta$ when f=1. If $\eta=0.5$ then a suitable value for $\Delta\eta$ may be $\Delta\eta=0.3$ or in the range $\Delta\eta\in[0.01,1-\eta]$. Note that $\eta+\Delta\eta\leq 1$. The compressed high band excitation is obtained by the element-wise multiplication of H and $\hat{X}_H$, i.e.:

$$\tilde{X}_H=H\,\mathrm{diag}(\hat{X}_H) \tag{31}$$

The expander 90 used on the high band envelope has a similar structure as the high band excitation compressor:

$$G=\left(\frac{\max(\hat{E}(b))}{\hat{E}(b)}\right)^{-(\phi+\Delta\varphi\cdot f)}, b=b_{max}+1, b_{max}+2, \ldots, N_b \tag{32}$$

Here the absolute value $|\cdot|$ may be omitted since the envelope coefficients $\hat{E}(b)\geq 0$. For f=0 the expander will have minimum effect with the expansion coefficient $\phi$. A suitable value for $\phi$ may be $\phi=0$, since this would give an unaffected envelope for f=0. If a small expansion effect is always desirable, suitable values may for instance be chosen from the range $\phi\in[0,0.5]$. The maximum expansion is obtained for f=1, which gives the expansion factor exponent $-(\phi+\Delta\phi)$. The value for $\Delta\phi$ may be set to $\Delta\phi=1$ but the suitable value would depend heavily on the band structure and may be chosen from a wide range, e.g. $\Delta\phi\in[0.5,10]$. The expanded envelope $\tilde{E}(b)$ is obtained by element-wise multiplication of the envelope with the expansion function G, i.e.:

$$\tilde{E}_H=G\ \mathrm{diag}(\hat{E}_H) \tag{33}$$

where $\hat{E}_H$ represents elements the high band envelope $\hat{E}_H=[\hat{E}(b_{max}+1)\ \hat{E}(b_{max}+2)\ \ldots\ \hat{E}(N_b)]$. The expanded envelope is applied to the compressed high band fine structure to form the high band spectrum $\hat{Y}_H(b)$ in accordance with:

$$\hat{Y}_H(b)=\tilde{X}_H(b)\cdot\tilde{E}(b), b=b_{max}+1, b_{max}+2, \ldots, N_b \tag{34}$$

The synthesized low band spectrum $\tilde{Y}_L(b)$ and the synthesized high band spectrum $\hat{Y}_H(b)$ are combined in the spectrum combiner 84 to form the synthesis spectrum $\hat{Y}$ which is input to the inverse frequency transformer 86 to form the output signal $\hat{y}$.

The joint control parameter f may be derived from parameters already available in the decoder 200, or it may be based on an analysis done in the encoder and transmitted to the decoder. Here, as for the time domain BWE case, we rely on an estimate on the high band spectral tilt. Such an estimate may be derived from the envelope parameters by measuring the quotient $q_m$ of the sums of the envelope coefficients in each half of the high band signal, i.e.:

$$q_m=\frac{\sum_{b=b_{max}+1}^{b_{half}}\hat{E}(b)}{\sum_{b=b_{half}+1}^{N_b}\hat{E}(b)} \tag{35}$$

where $$b_{half}=\lfloor(N_b-b_{max})/2\rfloor+b_{max}+1 \tag{36}$$

The smoothing of the spectral tilt $t_m$ for frame m may be done the same way as in the time domain embodiment, e.g. using:

$$t_m=\beta\cdot q_m+(1-\beta)t_{m-1} \tag{37}$$

The mapping of the spectral tilt to the control parameter f may also be done using the same piece-wise linear function as in the time domain embodiment, i.e.:

$$f(t_m)=\begin{cases}0, & t_m\geq C_{max}\\ 1-(t_m-C_{min})/(C_{max}-C_{min}), & C_{min}\leq t_m<C_{max}\\ 1, & t_m<C_{min}\end{cases} \tag{38}$$

However, since the definition of the spectral tilt is different the constants $C_{max}$ and $C_{min}$ of the mapping function will be different. These will for instance depend on the band structure.

Figure 11:
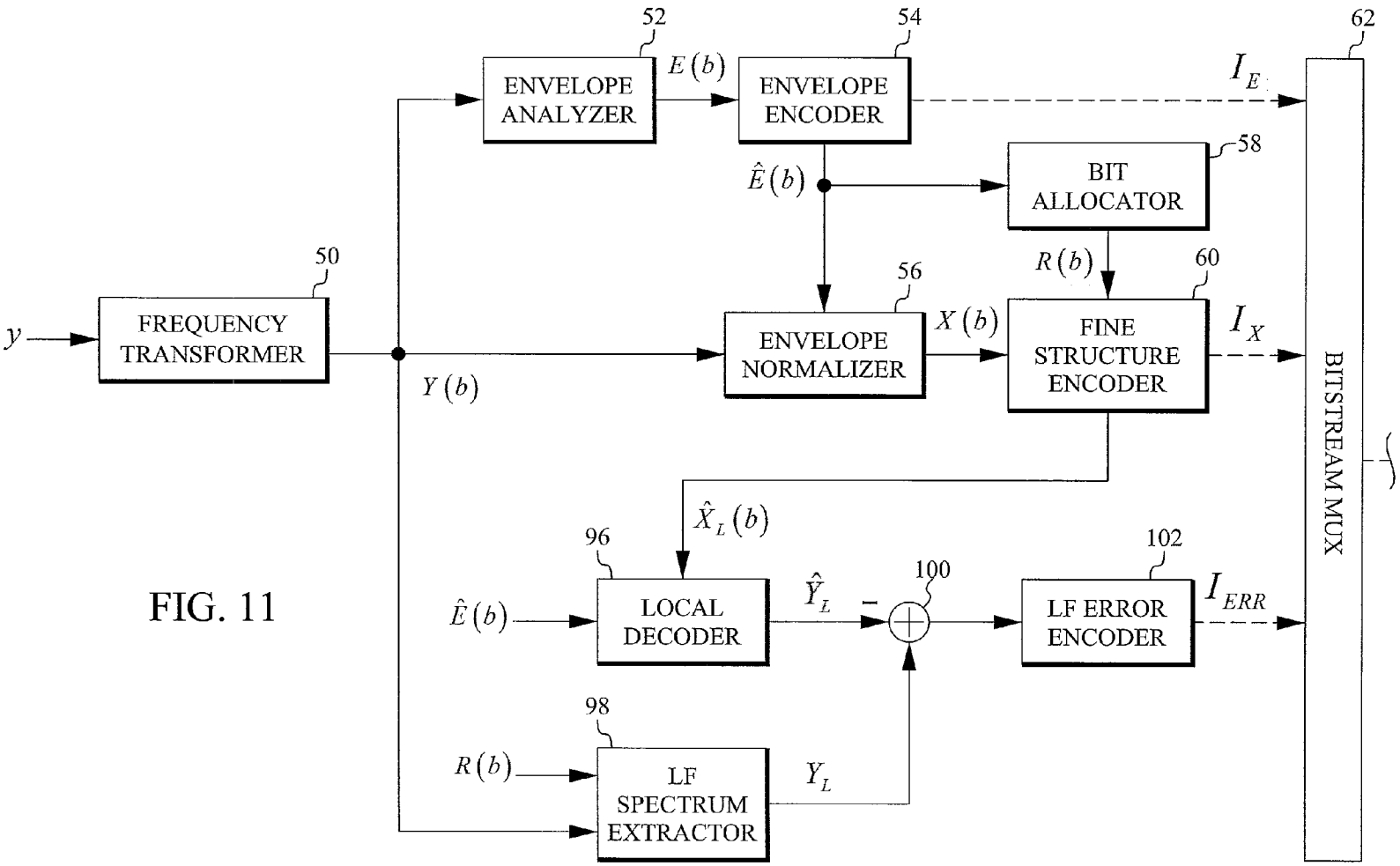
FIG. 11 illustrates an example embodiment of an encoder which has a local decoding unit and a low band error estimator.
Figure 12:
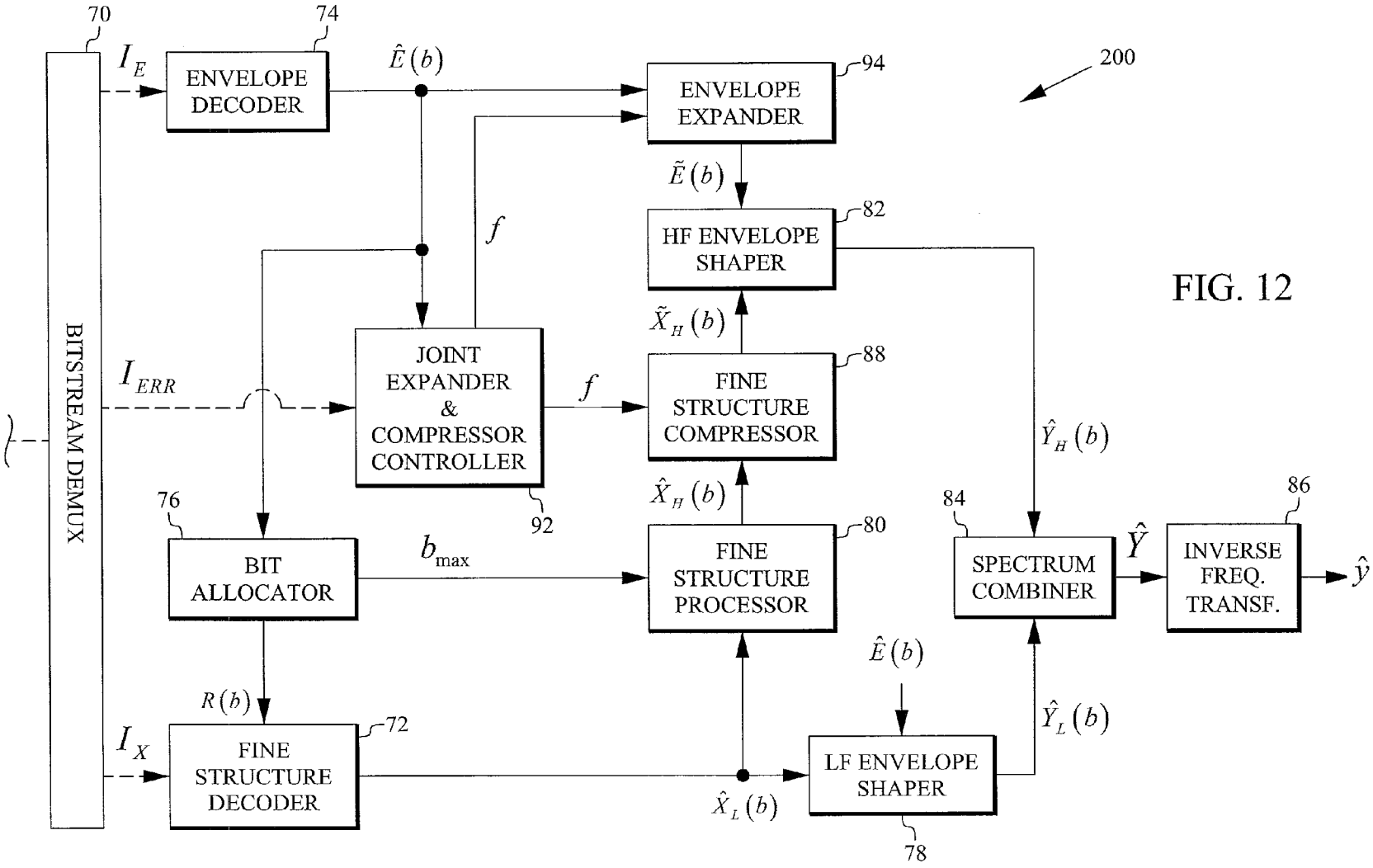
FIG. 12 illustrates an example embodiment of the proposed technology in a transform based decoder system with a joint control arrangement for excitation compression and envelope expansion, where the joint control is adapted using the low band error estimate from the encoder.

In an alternative to the frequency domain embodiment described above, the joint envelope and excitation control is adapted to the low band error signal which is estimated in the encoder, which is similar to the encoder in the system outlined in FIG. 8, but further has a local decoding and error measurement unit. An example of such a system is shown in FIG. 11, wherein the local decoding and error measurement unit includes a local decoder 96, a low frequency spectrum extractor 98, an adder 100 and a low frequency error encoder 102. In this embodiment a local low band synthesis is obtained by using the quantized envelope $\hat{E}(b)$ and a decoded low band fine structure $\hat{X}_L(b)$ which is extracted from the fine structure encoder. It may also be possible to run the full fine structure decoder to extract $\hat{X}_L(b)$ from the indices $I_X$, but a local synthesis can in general be extracted from the encoder with less computational complexity. A locally synthesized low band spectrum $\hat{Y}_L(b)$ is generated by shaping the decoded low band structure with the quantized envelope:

$$\hat{Y}_L(b)=\hat{X}_L(b)\cdot\hat{E}(b), b=1,2,\ldots b_{max} \tag{39}$$

The low band spectrum of the input signal $Y_L(b)$ is extracted from the full spectrum by finding the last quantized band using the bit allocation R(b). A low band error signal is formed as the log ratio of the input signal energy and the Euclidean distance between the synthesized low band spectrum from the input low band spectrum, i.e. a signal-to-noise ratio (SNR) measure $D_L$ on the low band synthesis defined as:

$$D_L=10\log_{10}\left(\frac{Y_LY_L^T}{(Y_L-\hat{Y}_L)(Y_L-\hat{Y}_L)^T}\right) \tag{40}$$

The low band SNR is quantized and the quantization indices $I_{ERR}$ are multiplexed together with the envelope indices $I_E$ and the fine structure indices $I_X$ to be stored or transmitted to a decoder. The low SNR encoding may be done e.g. using a uniform scalar quantizer.

The decoder 200 is similar to the decoder outlined in FIG. 9, but further has a combined control of a high band excitation compression which is jointly controlled with a spectral envelope expander as shown in FIG. 10. As in the time domain embodiments, a control parameter $f\in[0,1]$ is used for steering both the compressor and the expander.

Using the control parameter f the strength of the high band excitation compressor is adapted in accordance with:

$$H=\left(\frac{\max(|\hat{X}_H|)}{|\hat{X}_H|}\right)^{\eta+\Delta\eta\cdot f} \tag{41}$$

where $\Delta\eta$ gives the maximum compression factor $\eta+\Delta\eta$ when f=1. If $\eta=0.5$ then a suitable value for $\Delta\eta$ may be $\Delta\eta=0.3$ or in the range $\Delta\eta\in[0.01,1-\eta]$. Note that $\eta+\Delta\eta\leq1$. The compressed high band excitation is obtained by the element-wise multiplication of H and $\hat{X}_H$ in accordance with:

$$\tilde{X}_H=H\ \mathrm{diag}(\hat{X}_H) \tag{42}$$

The expander used on the high band envelope has a similar structure as the high band excitation compressor:

$$G=\left(\frac{\max(\hat{E}(b))}{\hat{E}(b)}\right)^{-(\phi+\Delta\phi\cdot f)},\quad b=b_{max}+1,\ b_{max}+2,\ \ldots,\ N_b \tag{43}$$

Here the absolute value $|\cdot|$ may be omitted since the envelope coefficients $\hat{E}(b)\geq0$. For f=0 the expander will have minimum effect with the expansion coefficient $\phi$. A suitable value for $\phi$ may be $\phi=0$, since this would give an unaffected envelope for f=0. If a small expansion effect is always desirable, suitable values may for instance be chosen from the range $\phi\in[0,0.5]$. The maximum expansion is obtained for f=1, which gives the expansion factor exponent $-(\phi+\Delta\phi)$. The value for $\Delta\phi$ may be set to $\Delta\phi=1$ but the suitable value would depend heavily on the band structure and may be chosen from a wide range, e.g. $\Delta\phi\in[0.5,10]$. The expanded envelope $\tilde{E}(b)$ is obtained by element-wise multiplication of the envelope with the expansion function G, i.e.

$$\tilde{E}_H = G\ \mathrm{diag}(\hat{E}_H) \tag{44}$$

where $\hat{E}_H$ represents elements the high band envelope $\hat{E}_H=[\hat{E}(b_{max}+1)\ \hat{E}(b_{max}+2)\ \ldots\ \hat{E}(N_b)]$. The expanded envelope is applied to the compressed high band fine structure $\tilde{X}_H(b)$ to form the high band spectrum $\hat{Y}_H(b)$ in accordance with:

$$\hat{Y}_H(b)=\tilde{X}_H(b)\cdot\tilde{E}(b), b=b_{max}+1, b_{max}+2, \ldots, N_b \tag{45}$$

The synthesized low band spectrum $\hat{Y}_L(b)$ and the synthesized high band spectrum $\hat{Y}_H(b)$ are combined in the spectrum combiner to form the synthesis spectrum $\hat{Y}$ which is input to the inverse frequency transformer to form the output signal $\hat{y}$.

In this embodiment the control parameter f is based on the low band SNR from the encoder analysis. First, a reconstructed low band SNR $\hat{D}_L$ is obtained from the low band error index $I_{ERR}$. The reconstructed low band SNR is mapped to a control parameter f using a piece-wise linear function:

$$f = \begin{cases} 0, & \hat{D}_L < D_{min} \\ (\hat{D}_L - D_{min})/(D_{max} - D_{min}), & D_{min} \le \hat{D}_L \le D_{max} \\ 1, & \hat{D}_L > D_{max} \end{cases} \tag{46}$$

where the constants $D_{min}$ and $D_{max}$ depend on the typical low band distortion values for this system. A suitable value for $D_{min}$ may be $D_{min}=10$ or any value in the range $D_{min}\in[5,20]$, while suitable values for $D_{max}$ may be $D_{max}=20$ or in the range $D_{max}\in[10,50]$. This relation will give stronger modification for high SNR values, corresponding to low distortion in the low band. It may also be desirable to have the opposite relation, such that strong modification would be used for low SNRs (high distortion values). Such a relation may be obtained by reversing the relation described above, i.e.:

$$f = \begin{cases} 1, & \hat{D}_L < D_{min} \\ (D_{max} - \hat{D}_L)/(D_{max} - D_{min}), & D_{min} \le \hat{D}_L \le D_{max} \\ 0, & \hat{D}_L > D_{max} \end{cases} \tag{47}$$

It shall be noted that the compressor and expander function may change the overall energy of the vectors. Preferably the energy should be kept stable and there are many available methods for handling this. One possible solution is to measure the energy before and after the modification and restore the energy to the value before compression or expansion. The energy measurement may also be limited to a certain band or to the higher energy regions of the spectrum, allowing energy loss in the valleys of the spectrum. In this exemplary embodiment it is assumed that some energy compensation is used and that it is an integral part of the compressor and expander functions.

The steps, functions, procedures and/or blocks described herein may be implemented in hardware using any conventional technology, such as discrete circuit or integrated circuit technology, including both general-purpose electronic circuitry and application-specific circuitry.

Alternatively, at least some of the steps, functions, procedures and/or blocks described herein may be implemented in software for execution by suitable processing equipment. This equipment may include, for example, one or several micro processors, one or several Digital Signal Processors (DSP), one or several Application Specific Integrated Circuits (ASIC), video accelerated hardware or one or several suitable programmable logic devices, such as Field Programmable Gate Arrays (FPGA). Combinations of such processing elements are also feasible.

It should also be understood that it may be possible to reuse the general processing capabilities already present in the encoder/decoder. This may, for example, be done by reprogramming of the existing software or by adding new software components.

Figure 13:
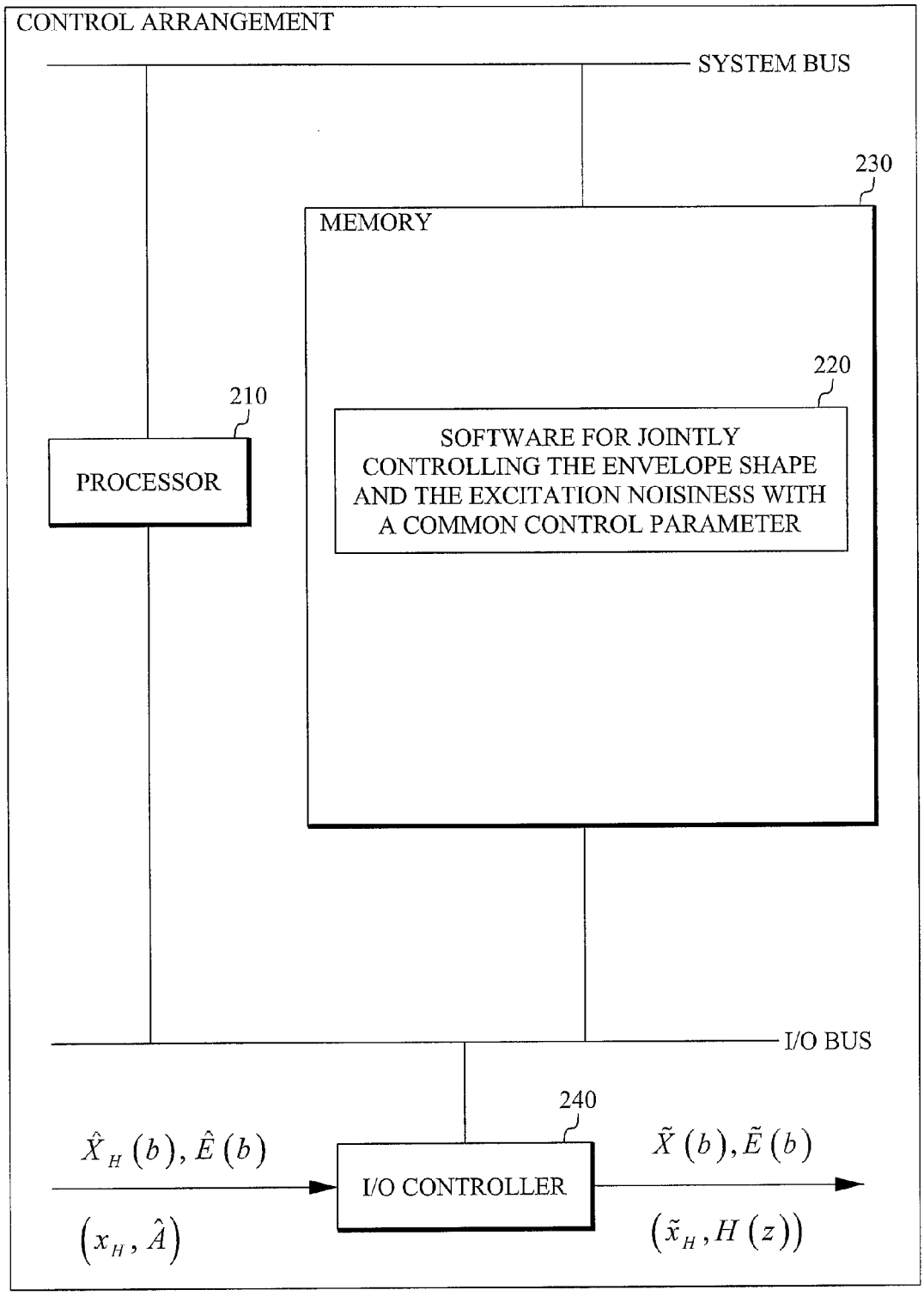
FIG. 13 illustrates an example embodiment of a control arrangement.

FIG. 13 illustrates an example embodiment of a control arrangement. This embodiment is based on a processor 210, for example a micro processor, which executes software 220 for jointly controlling the envelope shape and the excitation noisiness with a common control parameter. The software is stored in memory 230. The processor 210 communicates with the memory over a system bus. The input signals are received by an input/output (I/O) controller 240 controlling an I/O bus, to which the processor 210 and the memory 230 are connected. The output signals obtained from the software 220 are outputted from the memory 230 by the I/O controller 240 over the I/O bus. The input and output signals in parenthesis correspond to the time domain BWE and the input and output signals without parenthesis correspond to the frequency domain BWE.

An embodiment based on a measure co of spectral flatness may be structurally configured as in FIG. 13 with a processor, memory, system bus, I/O bys and I/O controller.

Figure 14:
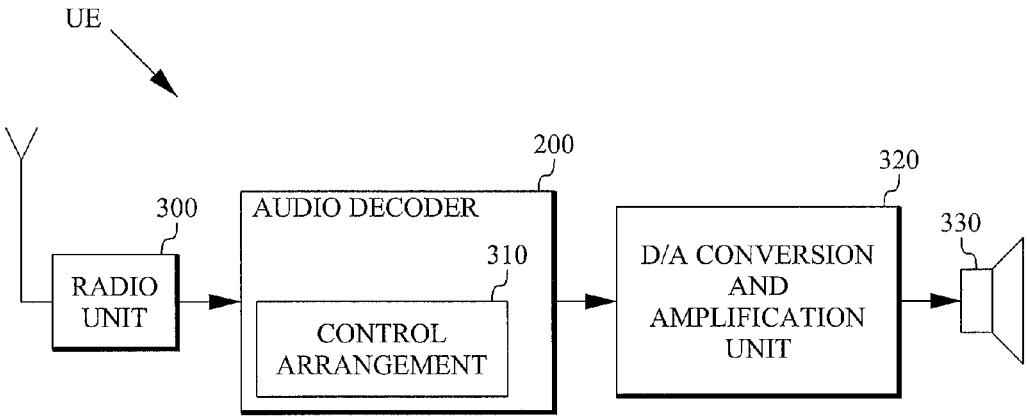
FIG. 14 illustrates a User Equipment (UE) including a decoder provided with a control arrangement.

The technology described above is intended to be used in an audio encoder/decoder, which can be used in a mobile device (e.g. mobile phone, laptop) or a stationary device, such as a personal computer. Here the term User Equipment (UE) will be used as a generic name for such devices. FIG. 14 illustrates a UE including a decoder provided with a control arrangement. A radio signal received by a radio unit 300 is converted to baseband, channel decoded and forwarded to an audio decoder 200. The audio decoder is provided with a control arrangement 310 operating in the time or frequency domain as described above. The decoded and bandwidth extended audio samples are forwarded to a D/A conversion and amplification unit 320, which forwards the final audio signal to a loudspeaker 330.

Figure 15:
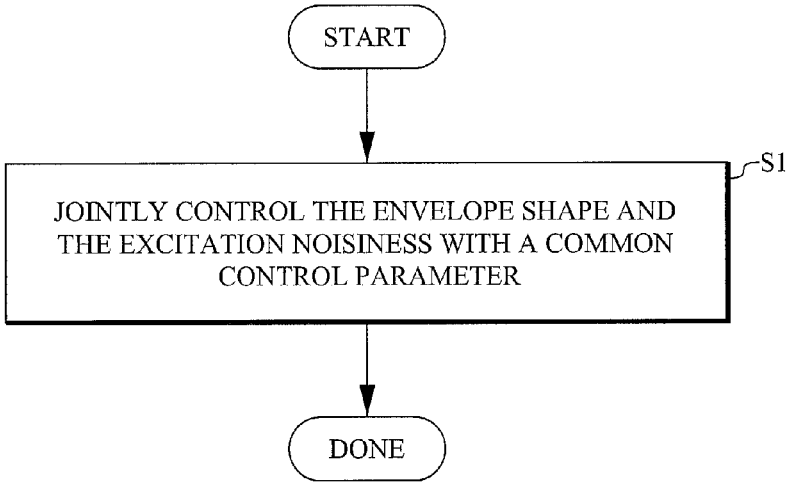
FIG. 15 is a flow chart illustrating the proposed technology.

FIG. 15 is a flow chart illustrating the proposed technology. Step S1 jointly controls the envelope shape and the excitation noisiness with a common control parameter f.

Figure 16:
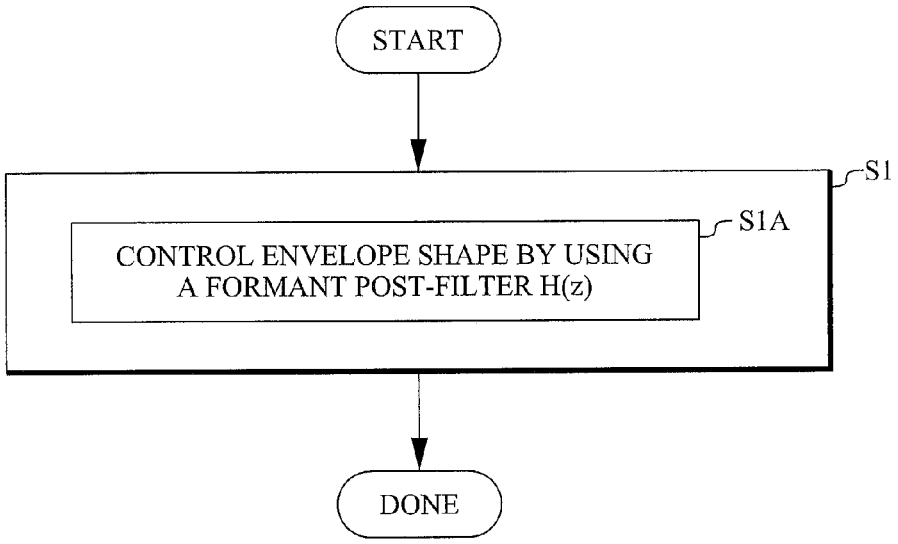
FIG. 16 is a flow chart illustrating an example embodiment of the proposed technology.

FIG. 16 is a flow chart illustrating an example embodiment of the proposed technology. In this embodiment step S1 includes a step S1A controlling the envelope shape by using a formant post-filter H(z), for example having the form defined by equation (6). The predetermined constants $\gamma_1$, $\gamma_2$ may, for example, be determined in accordance with one of the equations (7)-(10).

Figure 17:
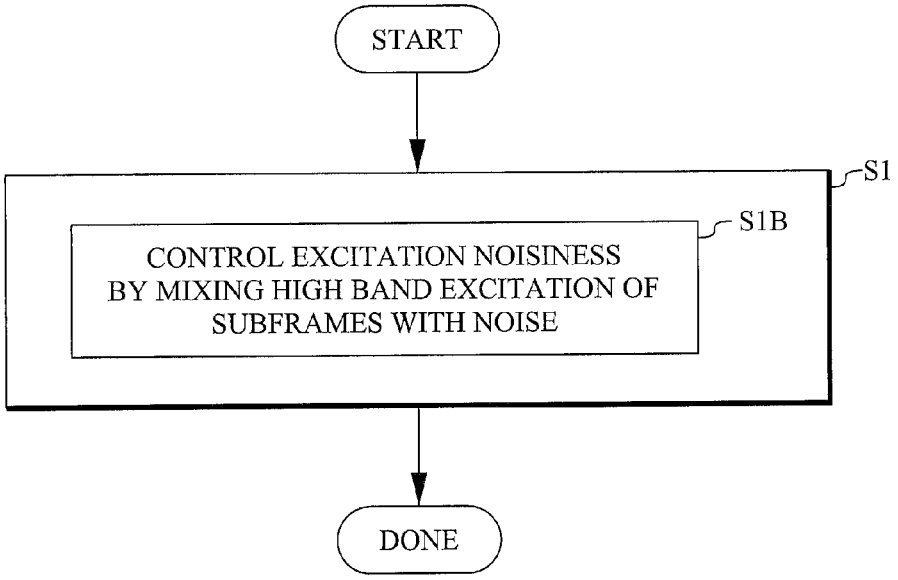
FIG. 17 is a flow chart illustrating an example embodiment of the proposed technology.

FIG. 17 is a flow chart illustrating an embodiment of the proposed technology. In this embodiment step S1 includes a step S1B controlling the excitation noisiness by mixing a high band excitation $x_{H,i}$ of a subframe i with noise $n_i$ in accordance with equation (1), where the mixing factors $g_x(i)$ and $g_n(i)$ are defined by, for example, equation (11) or (12), depending on the choice of predetermined constants $\gamma_1$, $\gamma_2$.

Figure 18:
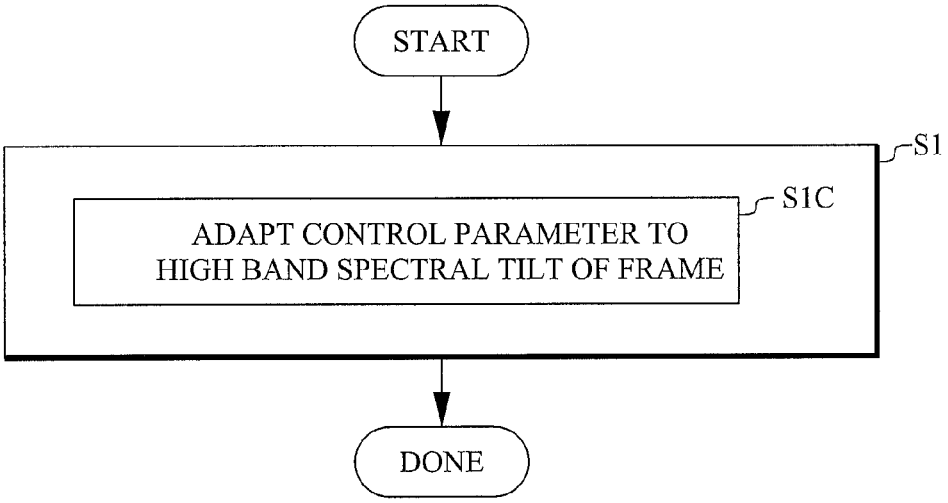
FIG. 18 is a flow chart illustrating an example embodiment of the proposed technology.

FIG. 18 is a flow chart illustrating an embodiment of the proposed technology. In this embodiment step S1 includes a step S1C adapting the control parameter f to a high band spectral tilt $t_m$ of frame m, for example in accordance with equation (18). In one embodiment the high band spectral tilt $t_m$ may be approximated using the second coefficient $a_{1,m}$ of the decoded linear predictor filter $\hat{A}_m\{1, a_{1,m}, a_{2,m}, \ldots, a_{P,m}\}$ of frame m, where P is the filter order. It is generally also beneficial to smoothen the high band spectral tilt $t_m$, for example in accordance with one of the equations (13), (15)-(17). An embodiment based on a measure $\phi$ of spectral flatness may perform step S1C using the approach described with reference to equations (19)-(22)

Figure 19:
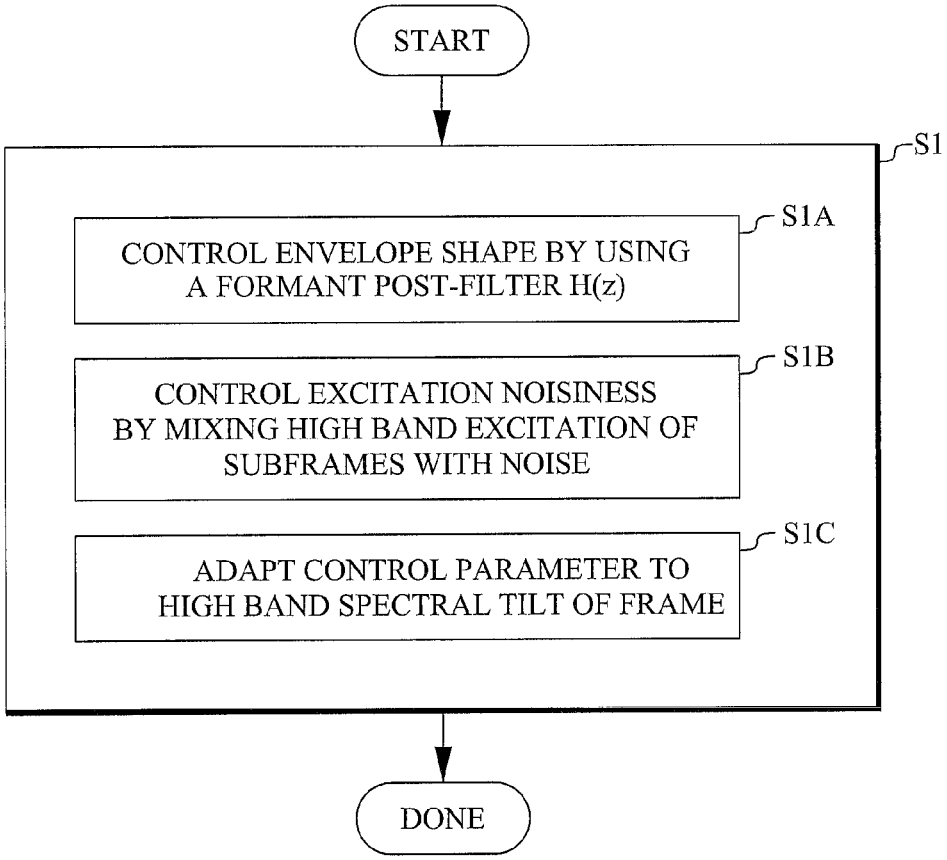
FIG. 19 is a flow chart illustrating an example embodiment of the proposed technology.

FIG. 19 is a flow chart illustrating an embodiment of the proposed technology. This embodiment combines the described steps S1A, S1B, S1C. Typically the control parameter f is determined first. It is then used to perform steps S1A and S1B. Other combinations including S1A+S1C or S1B+S1C are also possible.

It will be understood by those skilled in the art that various modifications and changes may be made to the proposed technology without departure from the scope thereof, which is defined by the appended claims.

ABBREVIATIONS

ASIC Application Specific Integrated Circuit
BWE Bandwidth Extension
CELP Code Excited Linear Predictor
DCT Discrete Cosine Transform
DFT Discrete Fourier Transform
DSP Digital Signal Processor
FFT Fast-Fourier Transform
FPGA Field Programmable Gate Arrays
HF High Frequency
LF Low Frequency
LP Linear Predictor
LPC Linear Predictive Coding
MDCT Modified Discrete Cosine Transform
QMF Quadrature Mirror Filter
SBR Spectral Band Replication
SNR Signal-to-Noise Ratio
TCX Transform coded residual
UE User Equipment

REFERENCES

[1] "AMR-WB+: A new audio coding standard for 3rd generation mobile audio services", J. Mäkinen, B. Bessette, S. Bruhn, P. Ojala, R. Salami, A. Taleb, ICASSP 2005

[2] "Enhanced aacPlus encoder Spectral Band Replication (SBR) part", 3GPP TS 26.404 V10.0.0 (2011-03), sections 5.6.1-5.6.3, pp. 22-25.

The invention claimed is:

1. A method of generating a high band extension of an audio signal from an envelope and an excitation, wherein the method comprising:

jointly controlling envelope shape and excitation noisiness with a common control parameter f, said envelope shape being controlled by using a formant post-filter H(z) of the form:

$$H(z) = \frac{\hat{A}(z/\gamma_1)}{\hat{A}(z/\gamma_2)}$$

where $\hat{A}$ is a linear predictor filter representing the envelope, and $\gamma_1$, $\gamma_2$ are functions of the control parameter f.

2. The method of claim 1, wherein:

$$\begin{cases} \gamma_1 = \gamma_0 + f \cdot \Delta\gamma \\ \gamma_2 = \gamma_0 - f \cdot \Delta\gamma \end{cases}$$

where $\gamma_0$, $\Delta\gamma$ are predetermined constants.

3. The method of claim 1, further comprising:

controlling the excitation noisiness by mixing a high band excitation $x_{H,i}$ of a subframe i with noise $n_i$ in accordance with:

$$\tilde{x}_i = g_x(i)x_{H,i} + g_n(i)n_i$$

where the mixing factors $g_x(i)$ and $g_n(i)$ are defined by:

$$\begin{cases} g_x(i) = \sqrt{v(i)(1-\alpha f)} \\ g_n(i) = \sqrt{E_1(1-v(i)(1-\alpha f))/E_2} \end{cases}$$

where v(i) is a voicing parameter partially controlling the excitation noisiness, $\alpha$ is a predetermined tuning constant, $E_1$ is a frame energy of the high band excitations $x_{H,i}$ for all subframes i, and $E_2$ is a frame energy of the noise $n_i$ for all subframes i.

4. The method of claim 1, wherein:

$$\begin{cases} \gamma_1 = \gamma_0 + f \cdot \Delta\gamma_{sharp} \\ \gamma_2 = \gamma_0 - f \cdot \Delta\gamma_{sharp} \end{cases}, f \geq 0$$

$$\begin{cases} \gamma_1 = \gamma_0 + f \cdot \Delta\gamma_{flat} \\ \gamma_2 = \gamma_0 - f \cdot \Delta\gamma_{flat} \end{cases}, f < 0$$

where $\gamma_0$, $\Delta\gamma_{flat}$ and $\Delta\gamma_{sharp}$ are predetermined constants.

5. The method of claim 4, further comprising:

controlling the excitation noisiness by mixing a high band excitation $x_{H,i}$ of a subframe i with noise $n_i$ in accordance with:

$$\tilde{x}_i = g_x(i)x_{H,i} + g_n(i)n_i$$

where the mixing factors $g_x(i)$ and $g_n(i)$ are defined by:

$$\begin{cases} g_x(i) = \sqrt{v(i)(1-\max(0, \alpha f))} \\ g_n(i) = \sqrt{E_1(1-v(i)(1-\max(0, \alpha f)))/E_2} \end{cases}$$

where v(i) is a voicing parameter partially controlling the excitation noisiness, $\alpha$ is a predetermined tuning constant, $E_1$ is a frame energy of the high band excitations $x_{H,i}$ for all subframes i, and $E_2$ is a frame energy of the noise $n_i$ for all subframes i.

6. The method of claim 1, further comprising:

adapting the control parameter f to a high band spectral tilt $t_m$ of frame m.

7. The method of claim 6, wherein the control parameter f depends on the high band spectral tilt $t_m$ in accordance with:

$$f(t_m) = \begin{cases} 0, & t_m \geq C_{max} \\ 1-(t_m - C_{min})/(C_{max} - C_{min}), & C_{min} \leq t_m < C_{max} \\ 1, & t_m < C_{min} \end{cases}$$

where $C_{min}$ and $C_{max}$ are predetermined constants.

8. The method of claim 6, wherein the high band spectral tilt $t_m$ is approximated using the second coefficient $a_{1,m}$ of the decoded linear predictor filter $\hat{A}_m = \{1, a_{1,m}, a_{2,m}, \ldots, a_{P,m}\}$ of frame m, where P is the filter order.

9. The method of claim 8, wherein:

$$t_m=\beta\cdot\max(0,a_{1,m})+(1-\beta)t_{m-1}$$

where $t_m$ is the spectral tilt value of frame m, $t_{m-1}$ is the spectral tilt value of the previous frame m−1, and β is a constant in the range β=[0,0.5].

10. The method of claim 1, further comprising:

adapting the control parameter f to a measure of spectral flatness (ϕ) of the high band.

11. An audio decoder configured to generate a high band extension of an audio signal from an envelope and an excitation, comprising:

a control arrangement configured to jointly control envelope shape and excitation noisiness with a common control parameter f, said control arrangement comprising a joint post-filter and excitation controller configured to control the envelope shape by using a formant post-filter H(z) of the form:

$$H(z)=\frac{\hat{A}(z/\gamma_1)}{\hat{A}(z/\gamma_2)}$$

where

Â is a linear predictor filter representing the envelope, and $\gamma_1$, $\gamma_2$ are functions of the control parameter f.

12. The decoder of claim 11, wherein:

$$\begin{cases}\gamma_1=\gamma_0+f\cdot\Delta\gamma\\ \gamma_2=\gamma_0-f\cdot\Delta\gamma\end{cases}$$

where $\gamma_0$, Δγ are predetermined constants.

13. The decoder of claim 11, further comprising:

a mix controller configured to control the excitation noisiness by mixing a high band excitation $x_{H,i}$ of a subframe i with noise $n_i$ in accordance with:

$$\tilde{x}_i=g_x(i)x_{H,i}+g_n(i)n_i$$

where the mixing factors $g_x(i)$ and $g_n(i)$ are defined by:

$$\begin{cases}g_x(i)=\sqrt{v(i)(1-\alpha f)}\\ g_n(i)=\sqrt{E_1(1-v(i)(1-\alpha f))/E_2}\end{cases}$$

where

ν(i) is a voicing parameter partially controlling the excitation noisiness,

α is a predetermined tuning constant, $E_1$ is a frame energy of the high band excitations $x_{H,i}$ for all subframes i, and $E_2$ is a frame energy of the noise $n_i$ for all subframes i.

14. The decoder of claim 11, wherein:

$$\begin{cases}\gamma_1=\gamma_0+f\cdot\Delta\gamma_{sharp}\\ \gamma_2=\gamma_0-f\cdot\Delta\gamma_{sharp}\end{cases},\ f\geq 0$$

$$\begin{cases}\gamma_1=\gamma_0+f\cdot\Delta\gamma_{flat}\\ \gamma_2=\gamma_0-f\cdot\Delta\gamma_{flat}\end{cases},\ f<0$$

where $\gamma_0$, $\Delta\gamma_{flat}$ and $\Delta\gamma_{sharp}$ are predetermined constants.

15. The decoder of claim 14, comprising a mix controller configured to control the excitation noisiness by mixing a high band excitation $x_{H,i}$ of a subframe i with noise $n_i$ in accordance with:

$$\tilde{x}_i=g_x(i)x_{H,i}+g_n(i)n_i$$

where the mixing factors $g_x(i)$ and $g_n(i)$ are defined by:

$$\begin{cases}g_x(i)=\sqrt{v(i)(1-\max(0,\alpha f))}\\ g_n(i)=\sqrt{E_1(1-v(i)(1-\max(0,\alpha f)))/E_2}\end{cases}$$

where

ν(i) is a voicing parameter partially controlling the excitation noisiness,

α is a predetermined tuning constant, $E_1$ is a frame energy of the high band excitations $x_{H,i}$ for all subframes i, and $E_2$ is a frame energy of the noise $n_i$ for all subframes i.

16. The decoder of claim 11, wherein the joint post-filter and excitation controller is configured to adapt the control parameter f to a high band spectral tilt $t_m$ of frame m.

17. The decoder of claim 16, wherein the control parameter f depends on the high band spectral tilt $t_m$ in accordance with:

$$f(t_m)=\begin{cases}0, & t_m\geq C_{max}\\ 1-(t_m-C_{min})/(C_{max}-C_{min}), & C_{min}\leq t_m<C_{max}\\ 1, & t_m<C_{min}\end{cases}$$

where $C_{min}$ and $C_{max}$ are predetermined constants.

18. The decoder of claim 16, wherein the joint post-filter and excitation controller is configured to approximate the high band spectral tilt $t_m$ by using the second coefficient $a_{1,m}$ of the decoded linear predictor filter $\hat{A}_m=\{1, a_{1,m}, a_{2,m}, \ldots, a_{P,m}\}$ of frame m, where P is the filter order.

19. The decoder of claim 18, wherein:

$$t_m=\beta\cdot\max(0,a_{1,m})+(1-\beta)t_{m-1}$$

where:

$t_m$ is the spectral tilt value of frame m, $t_{m-1}$ is the spectral tilt value of the previous frame m−1, and β is a constant in the range β=[0,0.5].

20. The decoder of claim 11, wherein the joint post-filter and excitation controller is configured to adapt the control parameter f to a measure of spectral flatness (ϕ) of the high band.

21. A user equipment-comprising the audio decoder in accordance with claim 11.

* * * * *